US005169295A

United States Patent [19]

Stogner et al.

[11] Patent Number: 5,169,295

[45] Date of Patent: Dec. 8, 1992

[54] METHOD AND APPARATUS FOR COMPRESSING GASES WITH A LIQUID SYSTEM

[75] Inventors: John Stogner, Westiminster; Steve Westmoreland, Aurora; Dan J. Kicker, Castle Rock, all of Colo.

[73] Assignee: Tren.Fuels, Inc., Austin, Tex.

[21] Appl. No.: 760,502

[22] Filed: Sep. 17, 1991

[51] Int. Cl.[5] ..... F04B 35/02

[52] U.S. Cl. ..... 417/339; 91/508

[58] Field of Search ..... 417/339, 342, 345, 346, 417/347, 344, 393, 397; 91/508

[56] References Cited

U.S. PATENT DOCUMENTS

| | | | |
|---|---|---|---|
| D. 278,944 | 5/1985 | Bresie et al. | D34/28 |
| 255,222 | 3/1882 | Wang . | |
| 617,026 | 1/1889 | Keith . | |
| 636,013 | 10/1899 | Tolle . | |
| 912,888 | 2/1909 | Pulliam . | |
| 1,254,921 | 1/1918 | Meengs . | |
| 1,689,557 | 10/1928 | Nordell . | |
| 1,773,593 | 8/1930 | McLaughlin et al. . | |
| 2,092,717 | 9/1937 | Jodry . | |
| 2,141,731 | 12/1938 | Wolfrom et al. . | |
| 2,260,127 | 10/1941 | Tebbetts, Jr. . | |
| 2,621,608 | 12/1952 | McIntyre . | |
| 2,670,874 | 3/1954 | Wilkerson . | |
| 2,772,543 | 12/1956 | Berry . | |
| 2,897,762 | 8/1959 | Houvener . | |
| 2,943,635 | 7/1960 | Greer et al. . | |
| 2,979,903 | 4/1961 | Beck | 60/54.5 |
| 3,018,633 | 1/1962 | Halliwell . | |
| 3,070,030 | 12/1962 | Mashinter . | |
| 3,082,693 | 3/1963 | Smith . | |
| 3,282,305 | 11/1966 | Antolak | 141/5 |
| 3,303,786 | 2/1967 | Fanshawe . | |
| 3,355,271 | 11/1967 | Soan et al. | 48/174 |
| 3,572,035 | 3/1971 | Beroset et al. | 60/54.6 |
| 3,619,087 | 11/1971 | Beeman . | |
| 3,680,982 | 8/1972 | Jacobellis . | |
| 3,741,692 | 6/1973 | Rupp . | |
| 3,749,526 | 7/1973 | Ferrentino | 417/390 |
| 3,939,656 | 2/1976 | Goldfein | 60/381 |
| 3,994,627 | 11/1976 | Calzolari | 417/317 |
| 4,051,877 | 10/1977 | Fletcher et al. | 141/4 |
| 4,119,113 | 10/1978 | Meginniss, III | 137/99 |
| 4,139,019 | 2/1979 | Bresie et al. | 137/351 |
| 4,213,476 | 7/1980 | Bresie et al. | 137/2 |
| 4,285,709 | 8/1981 | Gram | 62/36 |
| 4,308,001 | 12/1981 | Hofbauer et al. | 417/364 |
| 4,319,900 | 3/1982 | Gram | 62/42 |
| 4,334,407 | 6/1982 | Barnes | 60/407 |
| 4,351,153 | 9/1982 | Kosmala | 60/581 |
| 4,368,008 | 1/1983 | Budzich . | |
| 4,380,242 | 4/1983 | Bresie et al. | 137/113 |

(List continued on next page.)

FOREIGN PATENT DOCUMENTS

| | | |
|---|---|---|
| 1226183 | 1/1987 | Canada . |
| 0108582 | 5/1984 | European Pat. Off. . |

OTHER PUBLICATIONS

Brochure Entitled: "'Gold Cup' Hydrostatic Transmission Application Manual", Hägglunds Denison Corp., Bulletin 330, 6th Edition, Nov. 1988.

Bode D., "Hydraulically Operated Gas Compressor Unveiled", Diesel Progress, North American, (date unknown but at least as early as Sep. 11, 1990).

(List continued on next page.)

*Primary Examiner*—Leonard E. Smith

*Attorney, Agent, or Firm*—Arnold, White & Durkee

[57] ABSTRACT

Method and apparatus for compressing gas. Two accumulators are alternately filled with gas from a gas-supplying conduit, and the gas is forced out of one end of the accumulators into a gas-receiving conduit by liquid forced into the other end of the accumulators. A reversible pump moves liquid from one accumulator to the other accumulator. The reversible pump is connected so that pump cavitation is prevented. The invention includes a switching system to switch liquid flow from one accumulator to the other accumulator. Liquid that leaks from the system may be resupplied using a liquid supply system that comprises a pressure container with a compressible element.

.64 Claims, 11 Drawing Sheets

U.S. PATENT DOCUMENTS

| | | | |
|---|---|---|---|
| 4,479,546 | 10/1984 | Bresie et al. | 166/369 |
| 4,483,376 | 11/1984 | Bresie et al. | 141/95 |
| 4,515,516 | 5/1985 | Perrine et al. | 417/38 |
| 4,527,816 | 7/1985 | Bresie et al. | 285/81 |
| 4,546,607 | 10/1985 | Kime | 60/372 |
| 4,585,039 | 4/1986 | Hamilton | 417/364 |
| 4,611,973 | 9/1986 | Birdwell | 417/342 |
| 4,619,240 | 10/1986 | Bedford et al. | 123/575 |
| 4,750,869 | 6/1988 | Shipman, III | 417/342 |

OTHER PUBLICATIONS

Brochure from Sulzer Burckhardt—Reliable Gas Technology—NGV—Natural Gas for Vehicles, Refuelling Systems (Undated).

Article entitled, "Tanker Truck Helps Gas Wells in Wyoming," reprint from Mar. 7, 1983 edition Oil & Gas Journal.

Article entitled, "CNG Delivered Directly To Customer," reprint from Aug. 15, 1983 edition Oil & Gas Journal.

Article entitled "Energy—Firm Provides Industrial Users Cheaper Cars" from Jan. 13, 1983 Denver BusinessWorld.

Article entitled "Oilfield Trucking—Hauling Gas An Alternative To Pipelines" from Oct. 1983 Western Oil Reporter.

Presentation by Fowler entitled "Transportation of Natural Gas by Truck from the Wellhead Directly to Pipelines and Industrial Users" presented at Marketing Gas Directly to Consumers Seminar in Houston, Texas on Oct. 17–18, 1983.

METHOD AND APPARATUS FOR COMPRESSING GASES WITH A LIQUID SYSTEM

BACKGROUND OF THE INVENTION

1. Field of the Invention

This invention relates to the method and apparatus for transporting and compressing gases, particularly flammable gases such as natural gas, but also other gases such as air.

2. Prior Art

There is presently no widespread use of natural gas to fuel automobiles in the United States. One major problem with using natural gas for this purpose is that fueling facilities are expensive to construct on a commercial scale. Moreover, gas fuels occupy a large volume unless they are stored at high pressure. Compressing gas fuels to high pressures with conventional mechanically-driven or rotary gas compression equipment is relatively expensive. In addition, compressing gases to high pressures (such as 1500 psig or higher) tends to cause all but the most durable compressor materials to wear quickly.

Conventional compressors cannot operate over a wide range of inlet pressures (such as about 400–3000 psig) that is generally required for mobile gas compression or delivery systems. Inlet pressures for conventional compressors are generally limited to narrow ranges, based upon the working pressures of the equipment and the ratio of the outlet pressure to the inlet pressure for each stage (usually a ratio of 3–4 for each stage is the maximum operable ratio for conventional compressors). In addition, conventional compressors typically often have a low maximum inlet pressure capability (such as 200 psig) due to the pressure limitations of the compressor case and crankshaft seals. The above limitations inherent in conventional compressors limits the use of these compressors for mobile gas delivery.

In addition to the above, present mobile gas delivery systems are inefficient because (absent a compressor on the delivery system) they cannot empty their stored volume below the pressure of the gas recipient.

Despite the problems associated with natural gas as a vehicle fuel, there is nevertheless increased impetus for the use of such gas for automobiles and other vehicles. Natural gas is generally less expensive than other fuels (on an equivalent thermal unit basis), and it burns relatively cleanly, alleviating increasing environmental concerns. Thus improved gas compression and transportation equipment will be increasingly valuable.

Some alternatives to conventional compressor systems have been developed for compressing natural gas. U.S. Pat. No. 4,585,039 to Hamilton discloses a system wherein fuel gas at low pressure is supplied to an inlet at the top of an upright working cylinder. The working cylinder is then filled with liquid through a bottom liquid inlet to force the gas from the cylinder and direct it into a storage cylinder. A check valve prevents backflow of gas from the storage cylinder as the liquid is drained from the working cylinder and as the working cylinder is again filled with low pressure gas. The process of filling the working cylinder with liquid to force gas from it into the storage cylinder is repeated to fill a gas storage cylinder. Two working cylinders may be provided so that, as one of them is drained, the other is filled with liquid. In this manner gas may be forced into a storage cylinder until the desired high pressure is achieved. Like the working cylinders, the storage cylinder has gas forced from it by filling it with liquid.

The system described in the Hamilton patent uses an open reservoir liquid hydraulic system as a liquid control means for alternately introducing liquid into the working cylinders and thereby forcing gas from these working cylinders. As shown in Hamilton, a system of electronic relays, pressure switches, and solenoid valves are used to control the liquid as it is switched from cylinder to cylinder. The liquid is pumped from an open reservoir directly into each cylinder as the control system dictates.

The Hamilton system pumps liquid from about atmospheric pressure to the discharge pressure of the gas in the cylinders. Upon switching of the solenoid valves, the liquid in the cylinders discharges from gas discharge pressure to about atmospheric pressure. In systems of this type, if the discharge pressure is sufficiently high, a significant vibration caused by decompression may be observed which is caused by the large pressure drop as the liquid is drained to atmospheric pressure.

The system shown in Hamilton requires that the fluid be pumped from essentially atmospheric pressure to the discharge pressure of the gas being compressed. The large pressure differential also generally causes energy transmitted to the liquid to be released in the form of heat when the liquid is returned to atmospheric pressure. Energy losses to heat may represent more than 50% of the total energy input to the system when compressing gas from about 1500 psig to about 3000 psig. The resultant heat will require a heat exchanger to handle peak heat dissipation loads. This exchanger load may sometimes approach 80% of the prime mover horsepower, which generally requires an addition of a large and expensive heat exchanger to the system. The energy loss through this exchanger represents needless and inefficient system energy consumption.

U.S. Pat. No. 4,515,516 to Perrine et al. discloses a two-cylinder gas compression system similar to the Hamilton system. In one embodiment of the Perrine et al. system, a closed loop hydraulic system is utilized. Instead of using an open liquid reservoir and unidirectional pump (with the accompanying valves for liquid flow switching), a reversible pump with a motor in a closed hydraulic system is used. Thus, one input-output of the pump is connected directly to the line leading to one cylinder, while the other input-output is connected directly to another line leading to the other cylinder.

In the Perrine et al. closed loop hydraulic system, the pump moves liquid into one cylinder until the divider reaches a desired position at the top of that cylinder. At this point a magnetic or pressure sensor changes state causing the pump to change direction and pump liquid from that cylinder into the other cylinder. This process is repeated for each cylinder, causing the pump to again reverse and pump liquid to the other cylinder upon the direction of the sensor. The Perrine et al. patent discloses use of a variable volume pump.

An advantage of the Perrine et al. closed loop hydraulic system is that the hydraulic fluid is not released to atmospheric pressure after each compression cycle. Thus vibration effects are generally reduced because the pressure differential is reduced between: (1) the inlet and outlet of the pump, and (2) the inlet and outlet of the liquid sent to the compression cylinders. Moreover, energy efficiency of the system is generally increased for the same reason.

Both U.S. Pat. No. 4,515,516 to Perrine et al. and No. 4,585,039 to Hamilton are incorporated by reference.

SUMMARY OF THE INVENTION

It is a general object of the present invention to provide an effective and efficient system for transporting and compressing gas, particularly compressible fuel gas such as natural gas.

The present invention comprises the following basic elements:

(1) a first accumulator;

(2) a second accumulator;

(3) a gas-supplying conduit connected to the accumulators;

(4) a gas-receiving conduit connected to the accumulators; and (5) liquid control means for alternately introducing liquid into the first accumulator for forcing gas from it as liquid is drained from the second accumulator so as to cause the second accumulator to be refilled with gas from the gas-supplying conduit, and for introducing liquid into the second accumulator for forcing gas from it as liquid is drained from the first accumulator so as to cause the first accumulator to be refilled with gas from the gas-supplying conduit.

The gas from the system described above may be sent to a customer delivery point, pipeline, or a storage means. "Draining," as used herein, means the removal of liquid from a location. For instance, in a preferred embodiment liquid is forced from the accumulators by gas pressure and is thus "drained" from the accumulators. "Conduit," as used herein, means pipe, fittings, flanges, connectors or other equipment in which fluids may flow.

In addition to the above basic elements, the present invention may also comprise one or more of the following:

(a) a liquid supply means or system operable to supply liquid to the liquid control means (using e.g., a supply pump) at a pressure less than the pressure of the gas in the gas-supplying conduit;

(b) separators in each accumulator to separate the gas from the liquid;

(c) a system wherein a portion of the liquid is diverted from the liquid control means to a reservoir for the purpose of pump lubrication and cooling;

(d) a system wherein a liquid supply means supplies liquid to the liquid control means after liquid is substantially drained from the first accumulator and before the second accumulator is substantially filled, and after the liquid is substantially drained from the second accumulator and before the first accumulator is substantially filled;

(e) a system wherein the liquid control means comprises a reversible pump connectable to pump liquid to the first and second accumulators;

(f) a pressure container containing a compressible element connected to supply liquid to the liquid control means;

(g) a system wherein the liquid control means comprises a first sensing means connectable to switch the flow of liquid from the first accumulator to the second accumulator, and a second sensing means connectable to switch the flow of liquid from the second accumulator to the first accumulator, and wherein the sensing means are adapted to each send a switching signal to a directional control means which then causes the liquid to switch flow direction;

(h) a system wherein the liquid control means comprises a first sensing means connectable to switch the flow of liquid from the first accumulator to the second accumulator, and a second sensing means connectable to switch the flow of liquid from the second accumulator to the first accumulator, and wherein the sensing means are adapted to each send a switching signal to a stroker means which then causes the liquid to switch flow direction;

(i) a system wherein the liquid control means comprises an engaging means connectable to provide a run mode, a hold mold, and a stop mode for a reversible pumping means, and wherein the engaging means comprises a directional control means that sends a signal during use to the stroking means, and wherein the stroking means then sends a signal to the reversible pumping means;

(j) a liquid cooler to cool the liquid wherein the liquid cooler has a maximum pressure less than the pressure of the gas supplied by the gas-supplying conduit;

(k) a means to prevent backflow from the accumulators to the gas-supplying conduit;

(l) a means to prevent backflow from the gas-receiving conduit to the accumulators;

(m) a system wherein the rate of liquid flow to each accumulator is reduced before each accumulator is substantially filled with liquid; and (n) a system wherein the momentary liquid pressure in the accumulators is prevented from rising a set amount above the pressure of gas in the gas-receiving conduit.

The invention generally operates as follows: Gas is supplied at low or moderate pressure from a gas-supplying conduit and through an inlet on one end of an accumulator, followed by pumping liquid into the accumulator through an inlet on the opposite end of the accumulator. The liquid forces gas from the accumulator, and check means prevent backflow of gas into the gas-supplying conduit. Gas is directed from the accumulator to a gas-receiving conduit (and from there on to a customer, user, or storage location) through a check means to prevent backflow of gas from the gas-receiving conduit to the accumulator. The process is repeated until a sufficient desired quantity or pressure of gas is obtained.

Preferably the gas is compressed through the use of two accumulators in conjunction. Thus while one accumulator is compressing and discharging gas, the other accumulator is filling with uncompressed gas from the gas-supplying conduit. The accumulators are alternatively provided with liquid so that as liquid is drained from one accumulator, liquid is provided to the other accumulator.

Liquid is preferably pumped by a pressure compensated, variable volume, hydraulically stroked reversible pump. The pump operates by pumping liquid directly from one accumulator to the other accumulator. A certain percentage of the liquid preferably flows through the cavities in the pump back to a reservoir for pump cooling and lubrication. In addition, some of the liquid may flow through a cooler to cool a certain portion of the liquid. The liquid that flows through the cooler also preferably flows to the reservoir.

The liquid that is lost to the reservoir is preferably resupplied to the system by a liquid supply means or system preferably comprising a pressure container. The pressure container comprises a compressible element which is compressed as liquid is pumped therein, and which expands when liquid flows out of the pressure container. Essentially the compressible element operates as an energy storage means. When fluid is pumped into the pressure container, the element is compressed, thus storing energy. When the liquid flows out of the pressure container, the element expands, expending energy as it pushes the liquid out of the pressure container.

The pressure container is preferably connected to provide a momentary large volume of liquid to the reversible pump in a short amount of time. The large volume of liquid is necessary to prevent the reversible pump from "running dry" (i.e., running with insufficient suction fluid) or cavitating, thereby causing expensive damage to the reversible pump.

In general, the system is preferably controlled utilizing sensing means, directional control means, and stroker means. Each accumulator preferably comprises a separator between the liquid and gas in the accumulator. As the accumulator fills with liquid, the separator approaches one end of the accumulator and contacts a proximity sensing means.

The proximity sensing means generally comprises a modified directional control means. Servo liquid flows from a pressurized "servo pressure" source to the proximity sensing means. When the proximity sensing means is not in contact with a separator, then no servo liquid flows through the proximity sensing means. When the proximity sensing means is contacted by a separator, the separator mechanically moves an element (e.g., a piston) within the proximity sensing means, thereby directing the flow of servo pressure liquid such that the servo liquid flows through the proximity sensing means and to a first directional control means. When the separator retracts from the sensing means, then the sensing means returns to the same position it was at before it was contacted by the separator.

The first directional control means preferably directs the flow of pressurized supply liquid to a stroker means. When a pressurized servo liquid signal is sent from the proximity sensing means to the first directional control means, then the first directional control means switches state, thereby sending supply liquid (through a different port of the first directional control means) to the stroker means. In this manner a "directional" flow of liquid (i.e., flow of liquid in a certain direction) is achieved.

The stroker means is connected to the reversible pump. Essentially, a directional shift of supply liquid flow from the first directional control means thereby causes a directional switch of supply liquid flow in the stroker means. When the supply liquid flow switches direction in the stroker means, the directional flow of liquid being pumped by the reversible pump is reversed. In essence, the reversible pump will switch state, and instead of pumping liquid from the first accumulator to the second accumulator, the reversible pump will then pump liquid from the second accumulator to the first accumulator.

In addition to the direction of liquid pumped, the stroker means also controls and varies the rate at which liquid is pumped by the reversible pump (i.e., the compression liquid). The pressure of the supply liquid sent to the stroker means is proportional to the amount of compression liquid that the stroker means will direct the reversible pump to pump.

The reversible pump is made fail-safe by connecting the liquid supply means to both the supply liquid supply and the compression liquid pumped by reversible pump. In this manner, the liquid from the liquid supply means may flow to the reversible pump and become compression liquid, or may flow through to the first directional control means and becomes supply liquid. If the liquid pressure in the liquid supply means falls below a calibrated minimum value, then the stroker means (which obtains its liquid from the liquid supply means via the first directional control means) signals the reversible pump to pump less compression liquid. The liquid pressure in the liquid supply means generally is decreased when either of the inlets to the reversible pump is being starved for compression liquid. Thus if the reversible pump is being starved for compression liquid (a dangerous and expensive possibility), the pressure in the liquid supply means decreases, and the stroker means tells the reversible pump to reduce output. In this manner, if the reversible pump does not have enough compression liquid to pump, then the reversible pump stops pumping compression liquid.

In addition to the above, the system also comprises an engaging means to allow manual operation of the system. The engaging means comprises a second directional control means, which is in turn controlled by a manually operated pneumatic valve. The manually operated pneumatic valve allows the operator to set the system at "run," "stop," or "hold" positions. The pneumatic valve will send a signal to the second directional control means, which in turn interrupts the supply liquid signal (from the first directional control means to the stroker means) in one of three ways, thus signaling the reversible pump to "run," "stop," or "hold," as required.

In the more preferred embodiment, the compressor system described herein is mounted on a tractor trailer truck with pressure vessel storage means. The hydraulic pumps are connected via a transfer case to the engine of the tractor trailer truck. An advantage of the invention is that when this invention is mounted on a tractor trailer, then gas may be loaded onto, and off-loaded from, the trailer utilizing the mobile compressor located on the trailer. In this manner, the need for compression equipment at both the loading and off-loading points is eliminated.

Preferred embodiments of the invention may provide one or more of the following additional advantages:

(1) The system may be operated using hydraulic controls, and may avoid the source of ignition problem inherent in the use of electrical controls with combustible gas compression systems. In addition, the system may generally be less expensive to build because it may avoid expensive housing equipment necessary when electronic controls are utilized for combustible gas compression.

(2) The system may provide for a fail-safe system which prevents the reversible pump from "running dry" or cavitating. The system may automatically decrease or stop the pump output when the inlet pressure to the pump falls below a minimum level.

(3) The system may provide for precharging, priming, and lubrication prior to operating the reversible pump.

(4) The system may provide for a method to supply liquid to the system utilizing equipment that are operable at a pressure lower than the pressure supplied by the gas-supplying conduit. This equipment is generally less expensive. In addition, the system may avoid operational problems that would occur if the supply liquid was forced to overcome a varying amount of gas inlet pressure.

(5) The system may provide for additional cooling of the liquid within the system with a low working pressure cooler. Such coolers are generally lighter and less expensive than high pressure coolers otherwise required.

(6) The system may slow the rate of liquid flow into the accumulators when the accumulators approach being filled, thus possibly preventing operational problems caused by the separators contacting the ends of the accumulators at relatively high velocities.

(7) The system may prevent momentary pressure surges in the accumulators and associated equipment by providing a quick-response spring-loaded valve to release liquid pressure from the accumulators and associated equipment.

DETAILED DESCRIPTION OF THE PREFERRED EMBODIMENTS

Figure 1:
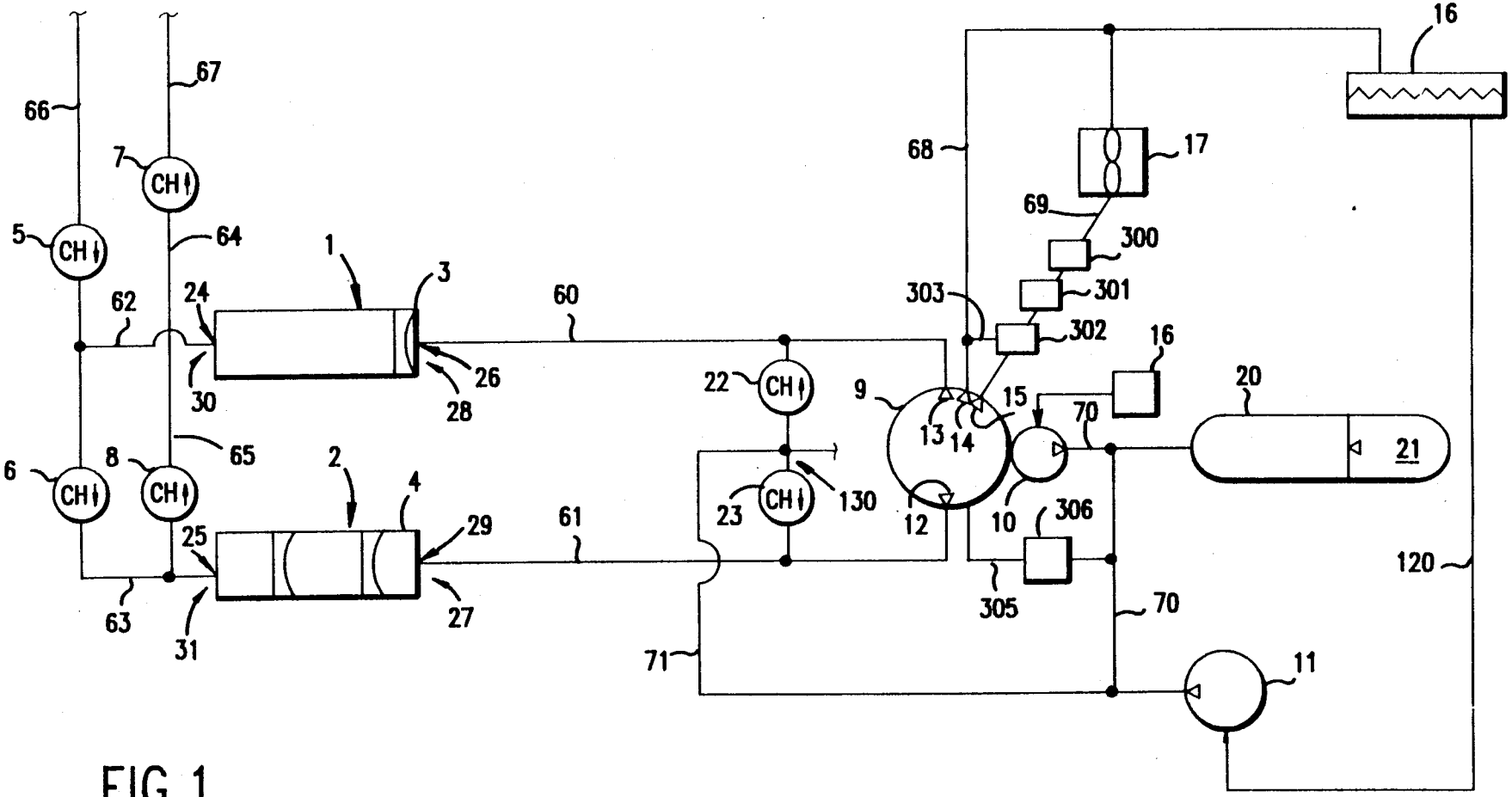
FIG. 1 is a schematic diagram for the apparatus for transporting and compressing gas showing the gas flow and liquid flow in one embodiment of the present invention.

FIG. 1 shows a preferred embodiment of the apparatus for transporting and compressing gas. More specific descriptions of the various equipment associated with this system is discussed below.

The Accumulators

As illustrated in FIG. 1, a preferred embodiment of the invention includes two closed accumulators 1 and 2. Other embodiments may include additional accumulators, for instance, a plurality of accumulators in parallel, or a system with a plurality of compression stages wherein each stage comprises a plurality of accumulators. The term "accumulator," as used herein, means a container adapted for the compression of gas with a liquid as described herein (e.g., a compression cylinder).

Each accumulator 1 and 2 is connected to a means to supply liquid into the accumulator to fill the accumulator. Each accumulator 1 and 2 also is connected to a means to drain liquid from the accumulator after it has been filled or partially filled. As part of the liquid supply and drain means, ports 26 and 27 in end members 28 and 29 connect the accumulators 1 and 2 with fluid lines 60 and 61, respectively. Liquid lines 60 and 61 alternately act as either a pressurized liquid supply or a liquid return line. For gas flow, ports 24 and 25 in end members 30 and 31 connect the gas inlet lines 62 and 63, and gas outlet lines 64 and 65, to the accumulators.

The accumulators 1 and 2 may be formed by lengths of steel pipe or tubing, or they may be cast. As shown in FIG. 1, accumulators 1 and 2 are enclosed on the gas ends by end members 30 and 31, and on the liquid ends by end members 28 and 29 respectively. The end members 28, 29, 30, and 31 generally connect to the accumulators I and 2 with flanged or threaded fittings to provide access to the accumulators 1 and 2 for maintenance and inspection. Threaded end members that screw into the accumulators are preferred.

While the accumulators 1 and 2 may be made in a wide variety of sizes and from a wide variety of materials, preferably accumulators 1 and 2 comprise nine inch inside diameter steel tubing. Nine inch accumulators made from steel tubing have been found to generally provide adequate sealing between the accumulators and separators within the accumulators (see separator description below). Generally, the system is designed to minimize separator velocities (preferably below 10 feet per second, more preferably below 2 feet per second), thereby enhancing seal life between the separator and the accumulator. In addition, preferably the separators and the end members 28, 29, 30, and 31 comprise steel. In a preferred embodiment, the overall length of the accumulator assembly is approximately 67 inches, and total volume of each accumulator is approximately 15 U.S. gallons.

Within the accumulators 1 and 2 are separators 3 and 4. The separators 3 and 4 may also be referred to as "floats," "dividers" or "pistons" by persons skilled in the art. The separators 3 and 4 are generally cylindrical, and the ends of the separators 3 and 4 that contact end members 28 and 29 are preferably concave or recessed to allow a larger surface area for liquid contact. "Recessed," as used herein, means that the separator is configured such that the cross-sectional area of the separator that is contactable by gas or liquid is larger than the cross-sectional surface area of the source of gas or liquid. Recessed separators 3 and 4 are shown in FIG. 1 (the separators shown in the other FIGS. have not been drawn as recessed, however recessed separators are generally preferred). It is to be understood that the separators 3 and 4 may be recessed on both the gas and the liquid side of the separator.

If the ends of the separators 3 and 4 are not recessed and fit flush against end members 28 and 29, then the initial liquid pressure provided through the cross-sectional area of ports 26 and 27 may not be sufficient to overcome the surface area difference between the gas side and liquid side of the separators 3 and 4 (i.e., the total force--pressure multiplied by cross-sectional area--on the gas side may exceed the total force on the liquid side).

Each separator 3 and 4 moves in both directions and preferably provides a substantially bubble tight sealing between the separator and the inside wall of the accumulator. A bubble tight sealing between the separator and the inside wall of the accumulator is preferred to keep the gas from mixing with the liquid and vice versa. Prevention of liquid and gas mixing is preferable to prevent liquid carryover into the gas (which could then require further separators) and gas mixing with the liquid (which could cause damage to the reversible pump). In another preferred embodiment, the separators 3 and 4 provide a substantially bubble tight sealing between themselves and the inside of end members 28 and 29. This embodiment may itself (or in conjunction with the seal between the separator and the inside wall of the accumulator) prevent gas from leaving the accumulator through liquid lines 60 and 61. Providing a seal between the separators 3 and 4 and the end members 28 and 29 is preferred because the sealing surfaces of the separators 3 and 4 that contact the end members 28 and 29 generally wear less than the sealing surfaces of the separators 3 and 4 that contact the inside of the walls of the accumulators 1 and 2.

In one preferred embodiment the separators 3 and 4 comprise steel, and preferably include non-metallic wear bands such as carbon-filled teflon. Many hard non-reactive materials are acceptable for the separators. Generally the preferred embodiments of this invention include separators in the accumulators 1 and 2. Such separators prevent mixing of the gas and liquid, and are generally necessary if horizontal compressing means are used. In addition, separators may be used to "trip" proximity switches, as discussed below.

Gas Flow

The gas compressed by this invention may comprise natural gas, methane, carbon dioxide, oxygen, air, nitrogen, ethane, hydrogen, propane, helium, argon, other noble gases, or any other gaseous compound. In addition, liquid may be pressurized instead of gas. In a preferred embodiment, this invention is adapted for use on a mobile gas compression and transportation system.

In operation of the embodiment of the invention shown in FIG. 1, gas flows through gas-supplying conduit 66 and alternatively through check means 5 or 6 into the accumulators 1 or 2 through ports 24 or 25. Upon being compressed by the force of the liquid against the separators 3 or 4, the gas is forced out of the accumulators through the same ports 24 or 25 through which the gas entered the accumulators. Upon leaving the accumulators through ports 24 or 25, the gas then flows through check means 7 or 8 and through gas-receiving conduit 67 and then to its destination. The check means 7 and 8 provide a means to prevent backflow of gas into the accumulators from the gas-receiving conduits as the separators 3 and 4 retract and liquid is drained from the accumulators 1 and 2. The check means 5 and 6 provide a means to prevent backflow of gas into the gassupplying conduit as the gas is forced (i.e., compressed) from the accumulators 1 and 2.

Figure 2A:
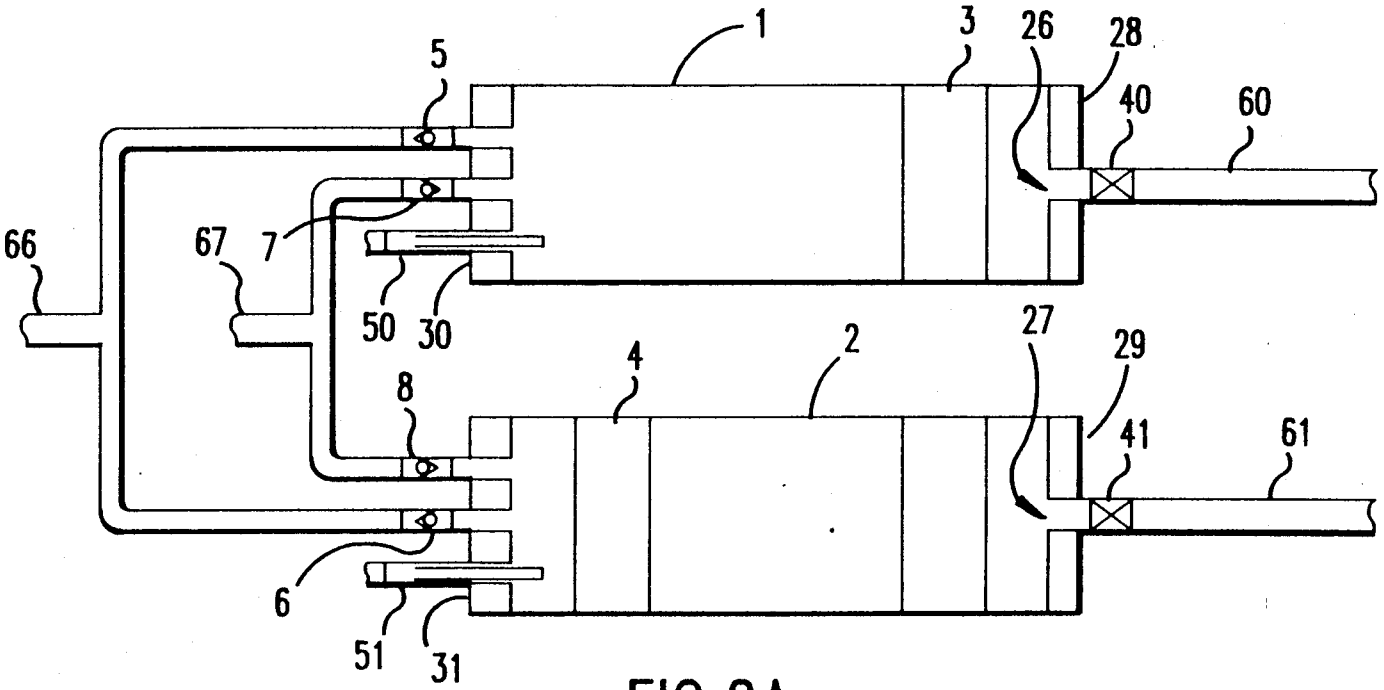
FIGS. 2A, 2B, and 2C depict an accumulator embodiment with three gas ports in the end member.

In a preferred embodiment as shown in FIG. 2A, the accumulators 1 and 2 are equipped with three gas ports in end members 30 and 31 for gas flow and separator proximity determination. As shown in FIG. 2A, the gas flows through line 66 and check means 5 and 6 into the accumulator. The gas flows out of the accumulators through check means 7 and 8 and into conduit 67. One advantage of the embodiment shown in FIG. 2A is that the gas generally flows in one direction through lines 66 and 67, thereby limiting energy loss and heat buildup because of reverse movement of gas in lines 66 and 67.

Sensing means 50 and 51 are inserted into accumulators 1 and 2 through separate ports in the accumulators. Preferably as shown in FIG. 2 the check means 5, 6, 7 and 8 are placed as close to the accumulators 1 and 2 as possible, thus limiting "dead space" clearance between the check means 5, 6, 7 and 8, and accumulators 1 and 2. Alternately, the check means 5, 6, 7 and 8 may be placed within the end members 30 and 31 for the same purpose. The clearance causes pumping efficiency loss because gas trapped in the "dead spaces" between the check means and the separators 3 and 4 is compressed but not sent to the gas-receiving conduit, and thus is not delivered. For example, if the clearance or "unswept volume" is approximately 10% of the total swept gas volume in the accumulators, then the system will need to actually compress approximately 100 cubic feet of gas to provide 90 cubic feet of compressed gas to the gas-receiving conduit.

In FIGS. 1 and 2A the conduit 66 is the "gas-supplying conduit," however the term "gas-supplying conduit" as used in this specification is defined to broadly include any equipment, process, or system that supplies gas. In FIGS. 1 and 2A the conduit 67 is the "gas-receiving conduit," however the term "gas-receiving conduit" as used in this specification is defined to broadly include any equipment, process, or system that receives gas. The gas-supplying conduit and the gas-receiving conduit may each comprise compressors, dehydrators, heaters, coolers, piping or pipelines, flexible tubing, check valves, meters, filters, flow control regulators and control valves, gauges, and any other equipment used in the gas processing and transportation industry, as is all well known in the art.

Figure 2C:
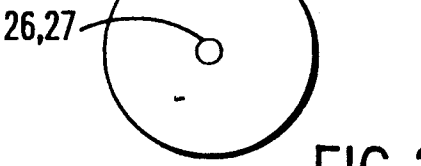
Figure 2B:
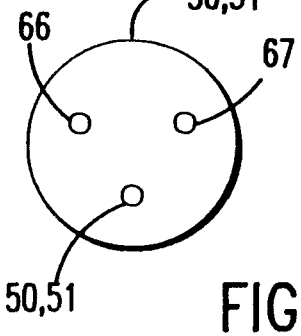

FIG. 2A also shows optional block valves 40 and 41 in liquid lines 60 and 61. FIG. 2B shows end members 30 and 31 with separate ports for the gas inlet 66, the gas outlet 67, and the sensing means 50 and 51. FIG. 2C shows end members 28 and 29 with liquid ports 26 and 27.

"Check means," as used in this specification is defined to include any means to prevent backflow. Such means may include check valves, wafer valves, compressor valves, or any other one-way device that allows flow in one direction but prevents flow in the reverse direction.

By alternatively flowing into one accumulator as gas is being compressed in the other accumulator, the system may provide a nearly continuous supply of low pressure gas to the accumulators, as well as a nearly continuous supply of high pressure gas out of the accumulators. If more alternating accumulators are added in parallel, then the total gas flow to and from the system becomes more continuous. Depending on inlet and outlet pressures to the accumulators, the separators 3 and 4 may travel a substantial amount of distance through the accumulators 1 and 2 before accumulator gas pressure overcomes pressure in the gas-receiving conduit, and gas then flows from the accumulators to the gas-receiving conduit.

Liquid Flow

Preferably the liquids used in the invention comprise hydrocarbon derivatives such as motor oil, hydraulic oil, synthetic oil, or a water-glycol solution. It is preferred that the liquids provide lubrication to moving parts within the system (e.g., the pumps), that the liquids have a viscosity ranging from about 160–1600 centipoise, and that the liquids are operable at temperature ranges of about 0° to 190° F. (more preferably about −50° F. to 220° F.). It is preferred that the liquids include oxidation inhibition properties, resist foaming, prevent rusting, and have adequate de-aeration properties. The preferred liquid that is used is AW-68, which is made by Amoco Oil Company, located in Chicago, Illinois. Although the liquids used in the system may be different for different conduits, operation and maintenance of the system is simplified if all liquids used for compression, supply, sensing, and control are the same liquid. Thus in a preferred embodiment the same liquid is used for compression, supply, sensing, and control. In general, no antiwear additives are presently used, since many commercial antiwear additives may have zinc additives that may corrode bronze conduits in the system (e.g., the reversible pump internals).

FIG. 1 shows a sohematio diagram of basic conduits in a "liquid control means." This liquid control means preferably comprises conduits 60 and 61, and the equipment that controls and pumps compression liquid. Conduits 60 and 61 are also referred to as the "first connector" and "second connector" respectively, and are used to connect the accumulators to the reversible pump 9.

The liquid control means more preferably comprises a "closed loop" reversible system—i.e., a system wherein compression liquid flows from accumulator i through line 60 and is forced into accumulator 2 through line 61, and vice versa. This reversible system differs from other "open loop" that return liquid from the accumulators to a low pressure (typically ambient) reservoir, and then pump the liquid from the reservoir to the accumulators Consequently, the inlet of reversible pump 9 generally does not receive compression liquid directly from a reservoir. "Pump," as used herein, means equipment used to pressurize liquid, such as positive displacement, rotary, or centrifugal pumps well known in the art.

The reversible pump 9 is preferably operable to vary the pump output volume according to specific operating conditions. For example, it is preferable to slow or even stop the pump output volume if compression liquid volume or pressure flowing to the reversible pump 9 falls below design criteria. In this manner the reversible pump 9 does not "run dry" or cavitate, thus preventing damage to the pump or other equipment within the system. One preferred way to vary output volume according to specific operating conditions is to vary the pump output ratio (i.e., the pump displacement per revolution of the shaft). Varying the pump output ratio is preferably achieved by an "overcenter" design pump 9.

Over-center pumps are well known in the art. In the preferred embodiment of the invention the reversible pump 9 comprises a Hagglunds/Dennison (Delaware, Ohio) Model P7P, P11P, or P14P Gold Cup Series over-center design pump.

The pump 9 preferably comprises design internal leakages for balancing, cooling, and lubrication purposes As shown in FIG. 1, the liquid that is leaked out of pump 9 flows through port 14 in line 68 to reservoir 16. In addition, some liquid may leak through port 15 and line 69 if an optional liquid cooler 17 is used. Lines 68 and 69 are "diverting conduits" for diverting a portion of the compression liquid from the reversible pump 9. In an alternative embodiment, ports 14 and 15 may be combined into one port and some or all of the liquid leaked through such port may be diverted to a cooler 17. In either case, the liquid generally flows from the cooler 17 to the reservoir 16.

Preferably the liquid that is not leaked internally through ports 14 or 15 is discharged through an internal pressure relief valve within pump 9 to the pump 9 case and on to the cooler 17. The cooler 17 may be designed for a working pressure lower than the gas in the gas-supplying conduit. A pressure reduction means 301 (as which is well known in the art) may be used to prevent high pressure liquid from contacting the cooler 17. In this manner the cooler may be built for less cost, is lighter, and is operationally safer. Preferably the cooler has a working pressure of less than 125 psig, more preferably less than 50 psig.

Figure 3:
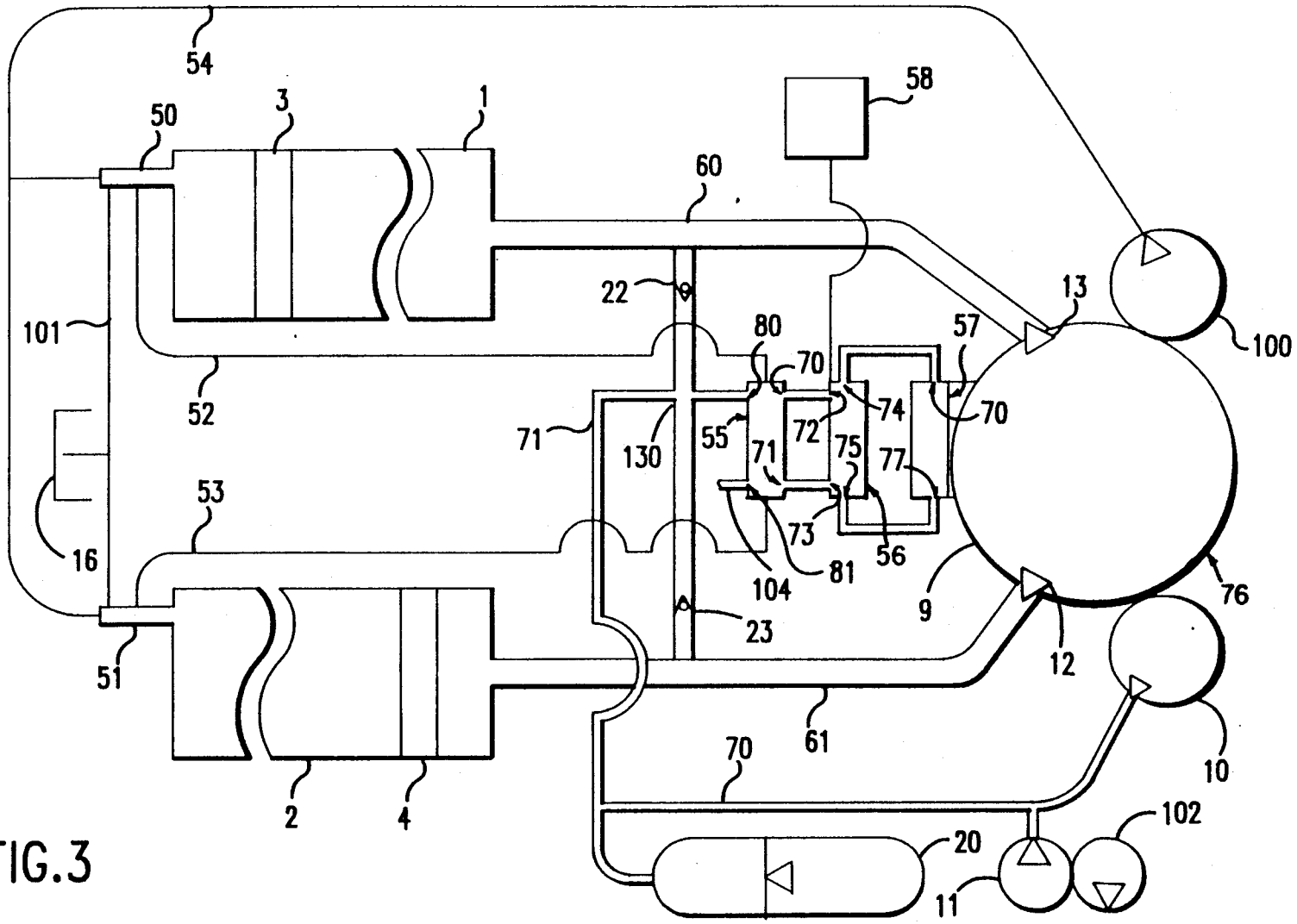
FIG. 3 is a schematic diagram showing the liquid control system in one embodiment of the present invention.

As shown in FIGS. 1 and 3, the pump 9 may also preferably comprise servo pump 100 (see FIG. 3) and supply pump 10. The servo pump 100 and the supply pump 10 may be internal or external to the pump 9, and may be independently powered or commonly connected to the same power supply as pump 9. As shown in FIG. 3, in a preferred embodiment the servo pump 100 and the supply pump 10 are internally connected to the pump 9 and have a common power supply. In the preferred embodiment, both the servo pump 100 and the supply pump 10 also perform other auxiliary internal functions of the reversible pump 9, as is well-known in the art.

The servo pump 100 may be connected to provide supply liquid to the sensing means 50 and 51 through line 54 as shown in FIG. 3. Preferably the servo liquid is the same liquid as other liquids throughout the system, albeit at a different pressure (about 500–700 psig).

The supply pump 10 pumps liquid from the reservoir 16 and replaces liquid to the system that is leaked out during the pumping process from the pump 9.

An independent supply pump 11 may also be optionally utilized in the system. The independent supply pump 11 is independently powered apart from the pump 9. In this manner the independent supply pump 11 may independently provide liquid to the liquid control system to lubricate, prime, and flush the system prior to start up. The independent supply pump 11 provides a source of additional liquid to prevent pump 9 from running dry. In addition, the independent supply pump 11 also provides for a faster fill of pressure container 20 (as described below) so that pressure container 20 has a sufficient volume to supply lines 60 or 61. The independent supply pump 11 may also perform secondary pumping functions.

In a preferred embodiment, one secondary function of the independent supply pump 11 is to supply pressurized liquid to a hydraulic motor, which in turn rotates a fan blade for a gas cooler in the gas-receiving means. The secondary functions of the independent supply pump 11 are shown in FIG. 3 as element 102. Alternately, the secondary functions of independent supply pump 11 may be performed by a completely separate pump. In the preferred embodiments, independent supply pump 11 comprises two pumps in one housing powered by a common shaft—one of the pumps provides supply liquid and one of the pumps provides liquid for secondary functions.

In addition to the above, the supply pump 10 and the independent supply pump 11 may provide alternate means to cool liquid in the system. Specifically, the supply pump 10 and the independent supply pump 11 may pump liquid to the case and housing of the pump 9 (schematically shown to flow through line 305 in FIG. 1). Preferably this liquid supplied by supply pump 10 and independent supply pump 11 is discharged through an integral pressure relief valve (schematically shown as 306) to the case of pump 9. Heat from the pump 9 is transferred to the liquid flowing therein and this liquid is subsequently sent to a cooler 17. Thus heat from the liquid passing through pump 9 is transferred to a cooler 17, instead of being retained in the liquid flowing in conduits 60 or 61.

In one embodiment, a thermostat 300 prevents flow of liquid from the pump 9 case to the cooler 17 when the liquid is below a certain set temperature. Thus at startup, when the liquid is below the set temperature, the thermostat prevents flow to the cooler 17, and liquid back pressure builds up in the case to a maximum pressure of about 65 psig, wherein a case relief valve 302 relieves liquid pressure to reservoir 16 through line 303. The liquid back pressure that builds up in the pump 9 case is usually beneficial since the pump 9 is usually designed such that communication between the pump 9 case and other parts of the pump 9 is possible, and thus the liquid in the pump 9 case may lubricate and prevent the pump 9 from running dry or cavitating during startup.

The preferred embodiment does not include a thermostat to prevent liquid flow from the pump 9 to the cooler 17. Instead, the cooler 17 is sized such that it is large enough to provide adequate liquid cooling at operating conditions, and also small enough so that liquid restrictions at startup (when the liquid is more viscous) cause liquid pressure buildup in the pump 9 case. The benefits of this liquid pressure buildup are discussed above. The preferred embodiment also includes a case relief valve 302 to relieve case pressure at about 65 psig.

In operation, compression liquid is discharged alternately through two ports 13 and 12 of the pump 9 into lines 60 and 61. The compression liquid then enters the accumulators 1 and 2 through ports 26 and 27. While compression liquid is forced into accumulator 1, compression liquid is being drained from accumulator 2, and vice versa. Thus (as shown in FIG. 1) compression liquid is forced from pump 9 through line 61 and through port 27 into working accumulator 2. This liquid moves separator 4, thereby forcing the gas out of accumulator 2, through port 25 and into line 65. Simultaneously, gas moves through line 62, through port 24 into accumulator 1, thereby moving separator 3 in the opposite direction and thereby pushing liquid out of port 26 through line 60 and back into pump 9.

Due to the fact that the compression liquid flows in a closed loop system, the liquid may only be drained as quickly as it is being discharged from pump 9 plus internal leakage through pump 9. For example, if pump 9 is pumping 75 gallons per minute ("gpm") and has a 5% internal leakage rate, then the maximum liquid return rate is about 78.75 gpm. In this manner the pump 9 has a "metering" effect on the compression liquid flowing to the pump 9 (liquid may be flowing to pump 9 from one accumulator at a slightly higher rate than the pump 9 discharge rate). Thus the amount of compression liquid supplied to the accumulators is usually less than the amount of compression liquid flowing to pump 9.

In a preferred embodiment, the gas pressure in the gas-supplying conduit is higher than the maximum output pressure of the liquid supply means operable to supply liquid to the liquid control means during operation. The liquid supply means (i.e., system) generally comprises conduit 70, 71, 120, check means 22 and 23, internal relief valves (not shown), pressure container 20, pressurized element 21, supply pump 10, and independent supply pump 11. Specifically, the supply pump 10, and the independent supply pump 11, are preferably designed for a maximum output pressure less than the minimum pressure of the gas-supplying conduit. Thus the conduits in the liquid supply means may be constructed to maximum working pressures that are much lower than the gas pressures in the gas-supplying conduit. Such conduits are significantly less expensive and weigh less (weight considerations are especially important for the preferred mobile gas compression system).

The following example illustrates the operation and benefits of the liquid supply means of the invention. The maximum pressure of the liquid supplied from the liquid supply means is less than the minimum pressure of the gas from the gas-supplying conduit. In the preferred embodiment the supply pump 10 has an maximum output pressure of about 350 psig, yet the maximum pressure of the gas-supplying conduit may range from about 400–2900 psig. Referring to FIG. 1, if the inlet pressure is higher than 350 psig, then no liquid may enter the "closed loop" liquid control means through line 71 while the separator is moving in accumulator 1 since the gas entering into accumulator 1 pressurizes the liquid that is being drained from that accumulator to about the pressure of the gas-supplying conduit. In other words, no supply liquid may be supplied to the reversible pump 9 at this point. Only when the separator 3 reaches the end point of its travel and seats next to end member 28 in the working accumulator 1 does the pump 9 begin to draw down the compression liquid pressure in line 60. Pump 9 draws down the pressure in line 60 because accumulator 2 will not yet be filled with liquid, since some of the liquid from accumulator 1 is leaked from the pump 9, as described above.

Thus line 60 will be depressurized by pump 9 to a pressure low enough to allow liquid from the liquid supply means to enter line 60 through lines 71 and check means 22. In this manner supply liquid is supplied to the reversible pump 9. In one embodiment, the supply pump 10 and/or the independent supply pump 11 may be designed to provide enough volume of pressurized liquid through line 71 to prevent the pump 9 from "running dry" and/or cavitating (thereby causing expensive damage to pump 9).

Alternatively, in a preferred embodiment the momentary output of the supply pump 10 and independent supply pump 11 may be designed to provide a lower output than the momentary output or demand of the pump 9. In such case, the liquid supply means further comprises a pressure container 20 to supply a relatively large momentary volume of pressurized liquid through line 71. The volume provided by the pressure container 20 is preferably large enough, when combined the volume from the supply pump 10 and the independent supply pump 11, to prevent the pump 9 from "running dry" and/or cavitating (i.e., large enough to meet the demand of pump 9). Moreover, this liquid is provided in the short time period "window" when separator 3 is next to end member 28 while separator 4 is still forcing gas out of accumulator 2. It is in this "window" that sufficient supply liquid is injected into the system to replenish the liquid lost through the internal leakages in pump 9.

Figure 8:
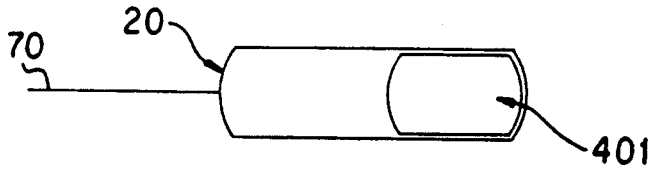
FIG. 8 is a schematic diagram showing a gas filled bladder in a pressure container.

The pressure container 20 preferably comprises a compressible element 21. Element 21 acts as a energy storage device. Element 21 may be a spring-loaded separator or simply a pocket of compressible gas. More preferably, the compressible element comprises a flexible bladder 401 filled with a compressible gas as shown in FIG. 8. The compressible gas preferably comprises nitrogen, argon, or any other inert gas that is nonexplosive. Nitrogen is the preferred gas. When the "window"

is open, as described above, element 21 expands to force fluid out of pressure container 20, through lines 70 and 71, through check means 22 or 23, and into lines 60 or 61.

During the majority of the system operation cycle no liquid flows through line 71 into lines 60 or 61 (i.e., the "window" is closed). Thus liquid from supply pump 10 and independent supply pump 11 flows into the pressure container 20 and compresses the element 21 to a smaller size. While pressure container 20 is being filled, the pressure in container 20 and in line 70 will rise. At a calibrated pressure a pressure relief valve means such as element 306 in FIG. 1 opens to allow liquid to flow from the liquid supply means, through the pump 9 case, and to reservoir 16. Alternately, the liquid may flow directly from the output of supply pump 10, independent supply pump 11, or line 70 to reservoir 16. In addition, the liquid may also flow to a cooler, and then to the reservoir 16.

Compression Liquid Control System

This section comprises a detailed explanation of the equipment and operation of the compression liquid control system.

In the preferred embodiment, the over-center design reversible pump 9 generally comprises a reversible pump and means to reverse the inlet and discharge ports of the pump 9. The term "over-center" refers to movement of a cam within the pump 9. The cam angle is the angle between the cam and a line perpendicular to a pump 9 shaft. It varies from a negative to a positive angle position, and vice versa (when in the zero angle position the cam angle is "on-center"). When in the negative angle position the liquid flows into the pump 9 from port 13, and out of the pump 9 through port 12. When in the positive position the liquid flows into the pump 9 through port 12, and out of the pump 9 through port 13.

Figure 4A:
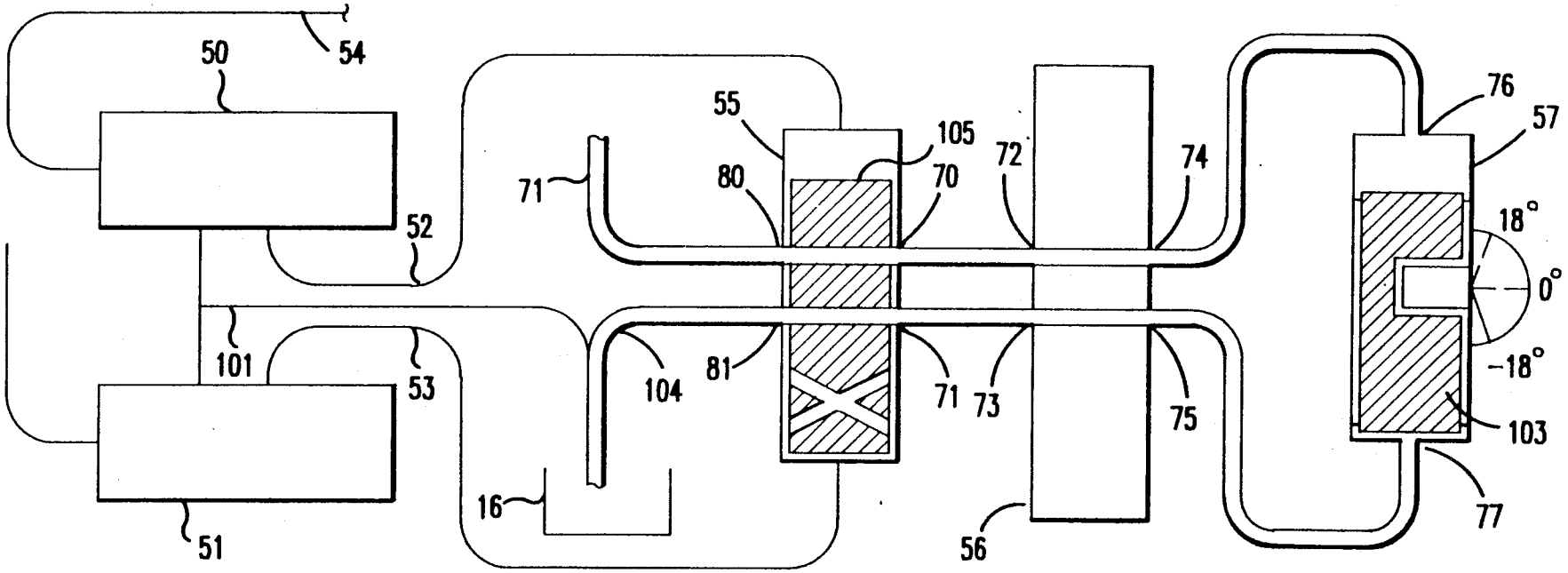
FIGS. 4A and 4B are schematic diagrams showing two modes of operation of the first directional control means and the stroker means.
Figure 4B:
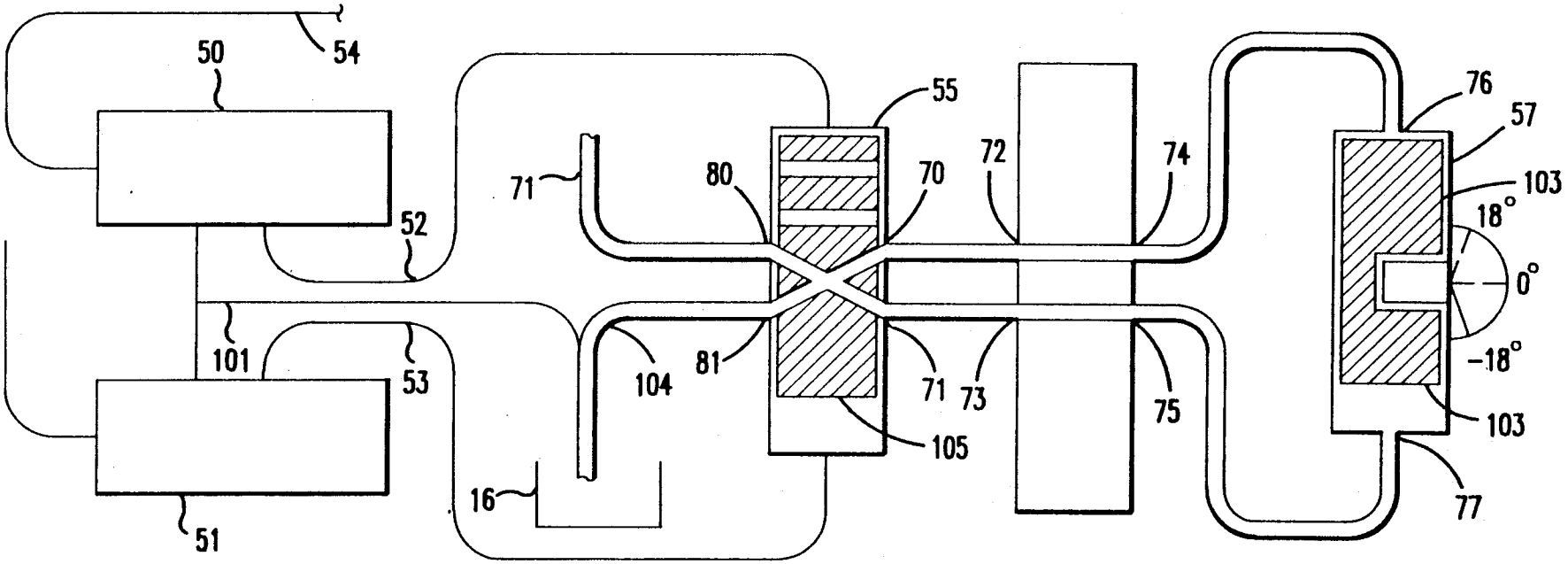

A preferred pump 9 is operable so that variance of the cam angle varies the amount of liquid flow in either direction. It is well known within the pump art to vary the amount of flow through a reversible pump in proportion to a varying cam angle. For instance, as shown in FIGS. 4A and 4B, in a preferred embodiment, if the cam angle varies approximately 18° in the positive direction, then the liquid will be pumped from port 12, out of port 13, and at a maximum rate (e.g., approximately 200 gpm). If the cam angle is 15°, then the liquid will be pumped out port 13 at a less than maximum rate (e.g., approximately 160 gpm). If the cam angle is 0°, then no liquid flows in or out of either port 12 or 13 (i.e., 4 the pump 9 is in neutral). If the cam angle is −15°, then the liquid flows from port 13, out of port 12, at a less than maximum rate (e.g., approximately 160 gpm). If the cam angle is −18°, then the liquid flows from port 13, out of port 12, at a maximum rate (e.g., approximately 200 gpm).

Preferably, the amount of cam angle is adjustable according to the amount of compression liquid pressure to the pump 9. In this manner if the pressure of the compression liquid flowing to the pump 9 decreases, then the amount of cam angle decreases and the amount of flow from the pump 9 decreases. Thus the pump 9 is prevented from running dry or cavitating, because before minimum compression liquid pressure is reached the cam angle will be 0°. The pressure of the compression liquid flowing to the pump 9 adjusts the cam angle via a stroker means 57, as described below.

As schematically shown in FIGS. 3, 4A, 4B, 5A, 5B, and 5C, preferably the stroker means 57 comprises a hydraulic stroker, which is well known within the art. As shown in FIGS. 4A and 4B, the stroker means 57 preferably comprises a dual port piston arrangement connected so that piston 103 movement is converted to proportional rotary cam angle movement. The piston 103 moves according to the direction and amount of supply liquid pressure. "Supply liquid," as used herein, means the liquid supplied to the compression liquid control system. In FIG. 3, the supply liquid is supplied via conduit 71 from intersection 130. In other words, the supply liquid is the liquid supplied to make up compression liquid leakage from pump 9, and the liquid supplied to the directional control means 55, engaging means 56 and/or stroker means 57 in FIG. 3 to control the pump 9 (i.e., the reversible pump controls). If equal supply liquid pressure (e.g., atmospheric pressure) is applied to the ports 76 and 77, then the piston 103 will remain in a center line position, causing the cam angle to be zero.

If the hydraulic supply liquid pressure is applied to a port 77 as shown in FIG. 4B, then the piston will move a distance in excess of a center line position that is in proportion to the amount of pressure applied, thereby causing rotary cam angle movement. If the hydraulic supply liquid pressure is switched from the port 77 to port 76 in the stroker means 57, then the piston 103 will move in the opposite direction in excess of the center line position that is proportional to the amount of pressure applied (see FIG. 4A). The stroker means 57 is preferably spring-loaded on both sides of the piston 103 so that if the pressure on one side of the piston 103 is decreased, then spring pressure helps move the piston 103 towards the center or neutral position.

It is anticipated that the hydraulic stroker may be replaced with an electronic stroking mechanism controlled by a pressure transducer. In operation, this pressure transducer feeds an analog signal into a programmable logic controller, which is connected to the electronic stroking mechanism and controls the electronic stroking mechanism such that the desired pump output is achieved. The electronic stroking mechanism is more energy efficient because in that embodiment the supply pump 10 is not required to supply pressurized supply liquid to a hydraulic stroker 57. The electronic stroking mechanism may be preferable for some applications (e.g., stationary applications) wherein it is preferable to achieve the maximum gas compression using minimal horsepower.

Figure 6A:
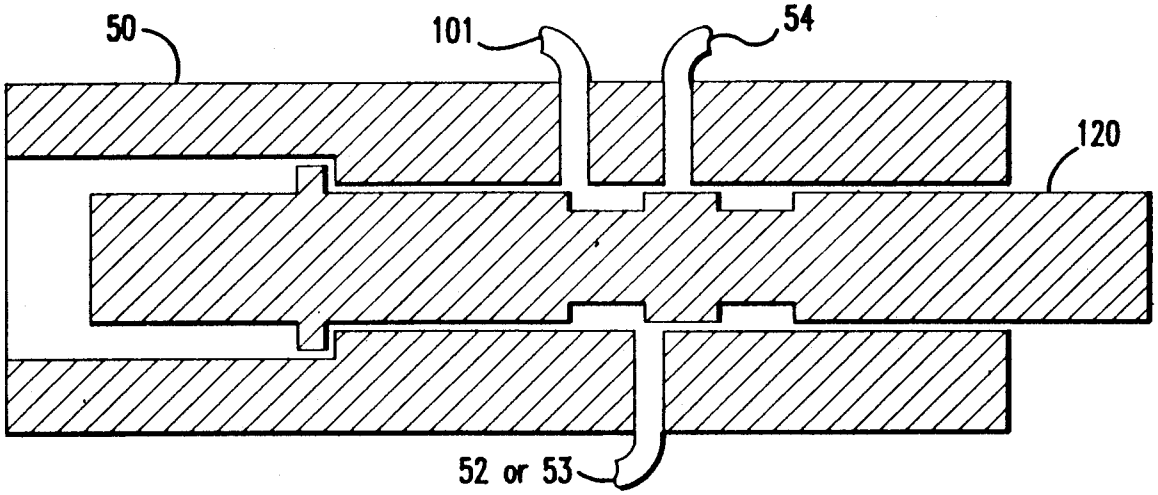
FIG. 6A and 6B show two modes of operation for the modified directional control valve in the sensing means.
Figure 6B:
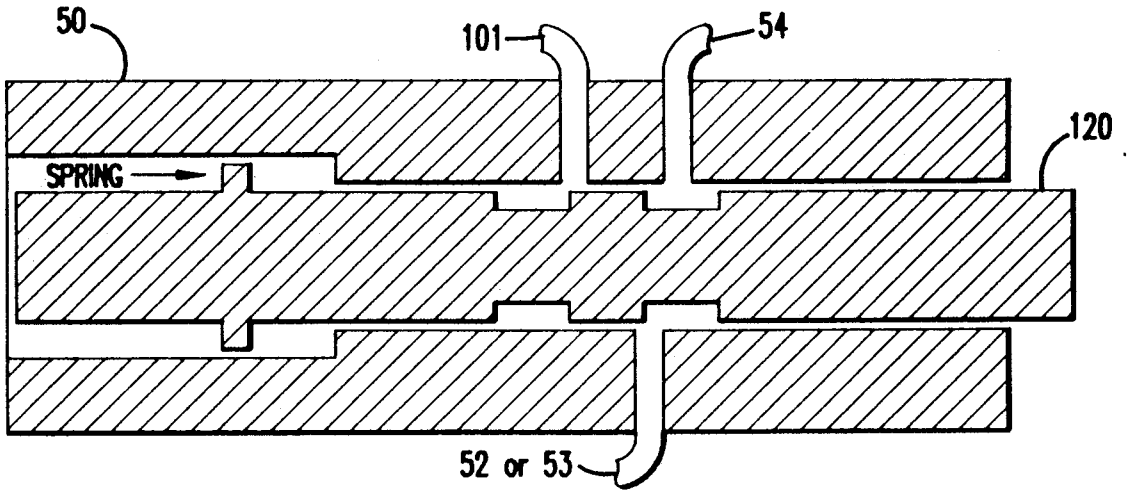

As shown in FIG. 3, automation and variation of the reversible pump 9 is initiated through the servo pump 100 and the liquid supply means. The servo pump 100 operates to provide servo liquid to the sensing means 50 and 51 which are connected to end members 30 and 31. As shown in FIGS. 6A and 6B, preferably the sensing means 50 and 51 comprise proximity switches which mechanically shift when contacted by separator 3 or 4 as gas is forced from the accumulators 1 and 2. When the sensing means 50 and 51 are not in contact with the separators 3 or 4, servo liquid is "deadheaded" in line 54 and does not flow. The servo liquid is provided to the sensing means 50 and 51 from the servo pump 100 at a pressure higher than the pressure in the liquid supply system (preferably at 500–700 psig) because at higher liquid pressures the sensing means 50 and 51 tend to respond faster.

As shown in FIGS. 3, 4A and 4B, in the preferred embodiment, when the separators 3 or 4 contact the sensing means 50 or 51, then servo liquid is diverted from the sensing means 50 or 51 through lines 52 or 53 to the first directional control means 55. See FIG. 6B, which depicts sensing means 50 when the piston 120 in sensing means 50 contacts the separator 3. In an alternate embodiment, the sensing means 50 and 51 may send a switching signal directly to the stroker means 57, without first passing through a directional control means 55 or engaging means 56. In this alternate embodiment, additional equipment must be employed to stop or slow the pump 9 if insufficient suction pressure is realized.

In a preferred embodiment, when the sensing means 50 or 51 breaks contact with the separators 3 or 4, then servo liquid no longer flows through lines 52 or 53, but instead is again deadheaded in line 54. See FIG. 6A, which depicts sensing means 50 when the piston 120 in sensing means 50 is not in contact with the separator 3. The sensing means 50 and 51 preferably comprise spring-loaded proximity switches, as shown in FIGS. 6A and 6B.

As shown in FIGS. 3, 4A and 4B, servo liquid from the sensing means 50 or 51 enters one of the chambers of the first directional control means 55, causing the directional control means 55 to change state and allow supply liquid to flow to the stroker means 57 (though preferably first through engaging means 56). In an alternate embodiment, the directional control means may simply send a signal to the pump 9 to cause the pump 9 to switch direction of compression liquid flow (e.g., via an electronic pump control system, or via a hydraulic signal connected to a pump speed control). As shown in FIGS. 4A and 4B, the first directional control means 55 preferably comprises a piston 105 with two alternate modes. In mode 1, as shown in FIG. 4B, the liquid from line 53 has pushed piston 105 so that the liquid from conduit 71 flows through ports 80, 71, 73, 75 and 77 respectively, thus moving the piston 103 in stroker means 57 so that a +18° cam angle occurs. At +18° angle, then compression liquid flows in through ports 12 and out through port 13 of pump 9 and into accumulator 1.

When accumulator 1 is filled, separator 3 mechanically pushes a moveable element in sensing means 50 such that a servo liquid pressure is temporarily diverted to line 52. At this point the piston 105 in the first directional control means 55 shifts to the position shown in FIG. 4A. As shown in FIG. 4A, control liquid flows in line 71 through ports 80, 70, 72, 74 and 76 respectively to force piston 103 in stroker means 57 to move the cam angle to the −18° position. At −18°, the pump 9 will pump maximum volume in through port 13 and out through port 12 from accumulator 1 to accumulator 2. As liquid is pumped from accumulator 1 the separator 3 breaks contact with sensing means 50, and the sensing means 50 automatically shifts the servo liquid from line 52 to the deadhead position. Since directional control valve 55 is preferably non-slip, it will stay in the same position (even without servo liquid pressure) until servo liquid pressure again exerts pressure on piston 105 through line 53.

Line 104 returns supply liquid to reservoir 16. Line 101 returns servo liquid to reservoir 16 when such liquid is forced from directional control means 55 by the movement of piston 105. The servo liquid is returned to the reservoir 16 from the directional control means 55 by backflowing through lines 52 or 53 through sensing means 50 and 51, and then through line 101 to the reservoir 16. As shown in FIG. 6A, the sensing means 50 and 51 are constructed such that liquid may backflow from lines 52 or 53 to line 101 when the separators 3 or 4 are not in contact with the sensing means 50 or 51.

As shown in FIG. 3, line 71 is connected to both the liquid supply system at intersection 130 through directional control valve 55, and the compression liquid system through check means 22 and 23. Thus if the pressure in lines 60 and 61 decreases, then the liquid pressure in lines 71, directional control valve 55, and stroker means 57 is reduced. If the liquid pressure in stroker means 57 is reduced, then the cam angle is reduced (though the direction of the cam angle remains the same—i.e., positive or negative). Thus the amount of compression liquid pumped by the pumping means 9 is thereby reduced, and the separators 3 and 4 reduce their speed of travel in accumulators 1 and 2. This reduction in the speed of the separators 3 and 4 is beneficial to avoid excessive shock loads and pressure surges on system equipment. Preferably the rate of liquid flow into the accumulators 1 and 2 is reduced when each accumulator is at least about 90% filled with liquid, more preferably about 95% filled with liquid. "Filled with liquid" means that the total available space for liquid in the accumulator is filled with liquid (i.e., this space doesn't include the space between the separator and the gas end of the accumulator, or the space taken by the separator itself).

One problem encountered with dual accumulator compression systems such as described herein is that the system experiences momentary liquid pressure surges in the accumulators during the short time period between (1) when the accumulators are actually filled with liquid, and (2) when the reversible pump actually reverses directional liquid flow. "Momentary," as used herein, is used to describe a condition such as a required flow rate or a pressure that lasts for a short period of time, typically less than 5 seconds and more typically less than 1 second. These momentary pressure surges may be mitigated by slowing the fill rate of the accumulators as the accumulators become nearly full, as described above. These momentary pressure surges may also be controlled by adding a compression liquid pressure compensation system.

In the preferred embodiment the compression liquid pressure compensation system monitors and controls the differential pressure between the gas pressure in the gas-receiving means and the liquid pressure in the accumulators. When the liquid pressure rises a set amount greater than the gas pressure in the gas-receiving means, then a valve connected to the liquid quickly opens and allows liquid pressure to be relieved to reservoir 16. In the preferred embodiment the pressure compensation system comprises a spring-loaded valve which comprises a center spring-loaded piston housed in a valve body and connected on opposite ends to the gas in the gas-receiving conduit and the liquid which pressure is being controlled. Preferably the spring-loaded valve is as close as possible to the pump 9 to control pressure surges as they affect pump 9. One of the major benefits of preventing momentary pressure surges is that the pump 9 discharge pressure does not vary as greatly, thus improving the operation of the pump 9.

Figure 7:
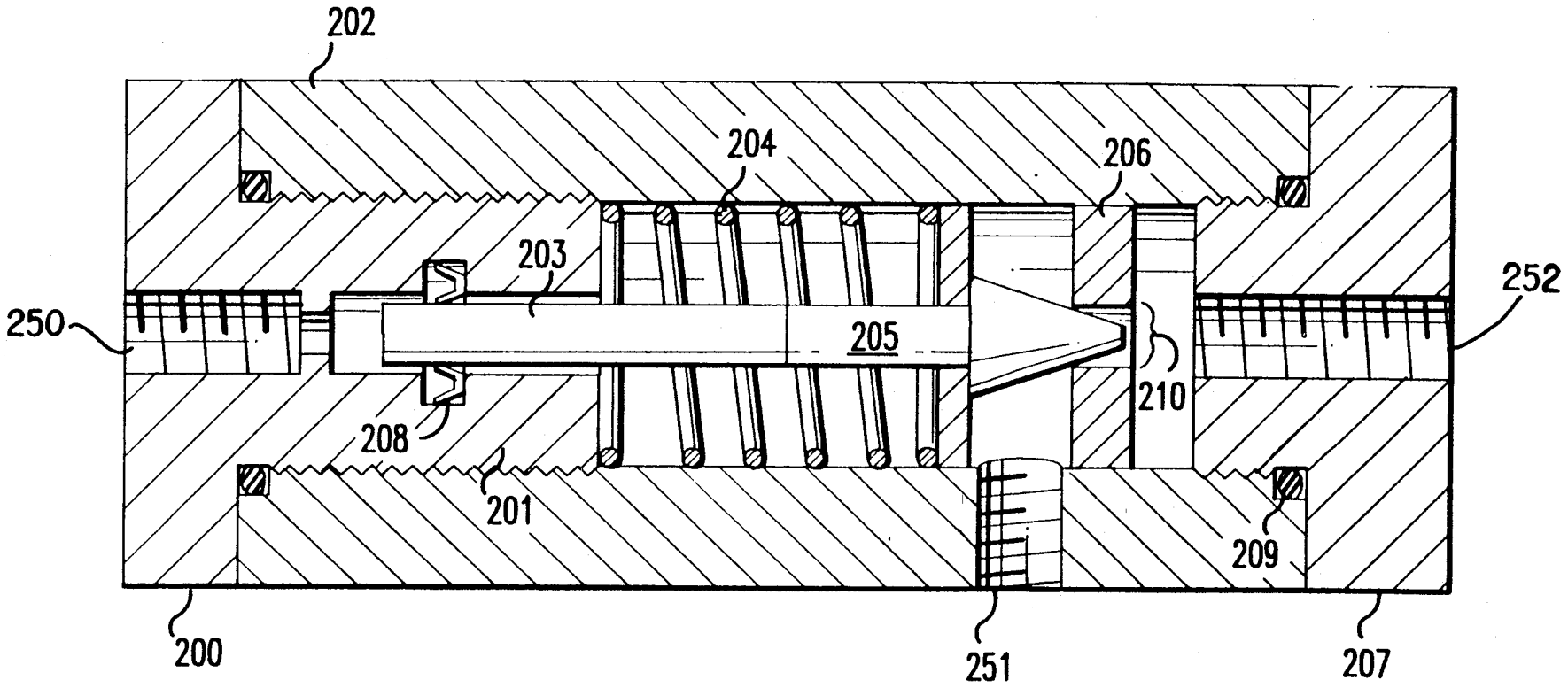
FIG. 7 is a diagram of a spring-loaded pressure compensation valve.

The spring-loaded valve has a third port which allows liquid to flow through the valve and to reservoir 16 when the spring pressure (which is the set differential pressure plus the gas pressure) is overcome by liquid pressure from the accumulator. The preferred set differential pressure is about 200–250 psig. The spring-loaded valve (such as shown in FIG. 7) differs from other relief valves known in the art in that it is specifically designed to react nearly instantaneously to control momentary liquid pressure surges. Such instantaneous reaction is generally beneficial since the momentary pressure surges only last a short period of time.

FIG. 7 is a diagram of a preferred spring-loaded valve 200. Gas enters the valve 200 via port 250 and liquid enters via port 252. The valve 200 includes a bubble-tight sealing means 208 to prevent communication between the gas and liquid. Liquid entering via port 252 pushes against piston 205 until the liquid pressure is sufficient to overcome the spring 204 differential pressure plus the gas pressure. When the liquid pressure exceeds the gas pressure plus the spring pressure, then liquid flows through opening 210 and port 251 to reservoir 16. The sizes of the piston 203, seat 206, and opening 210 may be varied to optimize valve 200 performance as needed. The compression liquid pressure compensation system limits the momentary pressure surges in the system, thus preventing compression liquid pressure from rising above a set amount necessary to compress gas in the system.

Referring back to FIGS. 4A and 4B, preferably the directional control means 55 is non-slip, meaning that once shifted, it will not move unless directed to by liquid from sensing means 50 or 51. Preferably the directional control means 55 is a detented directional control valve (e.g., it has a spring-loaded ball that fits within an indentation to provide non-slip properties).

As shown in FIG. 3, 4A and 4B, the liquid from the directional control means 55 may first pass through an engaging means 56, which is preferably a pneumatically operated second directional control means (and more preferably, a directional control valve). The engaging means 56 allows the operator to provide a neutral, holding, or automatic run mode for the system. It is preferably controlled by a manually operated pneumatic valve 58. The pneumatic valve 58 is preferably non-slip, and more preferably detented.

Figure 5A:
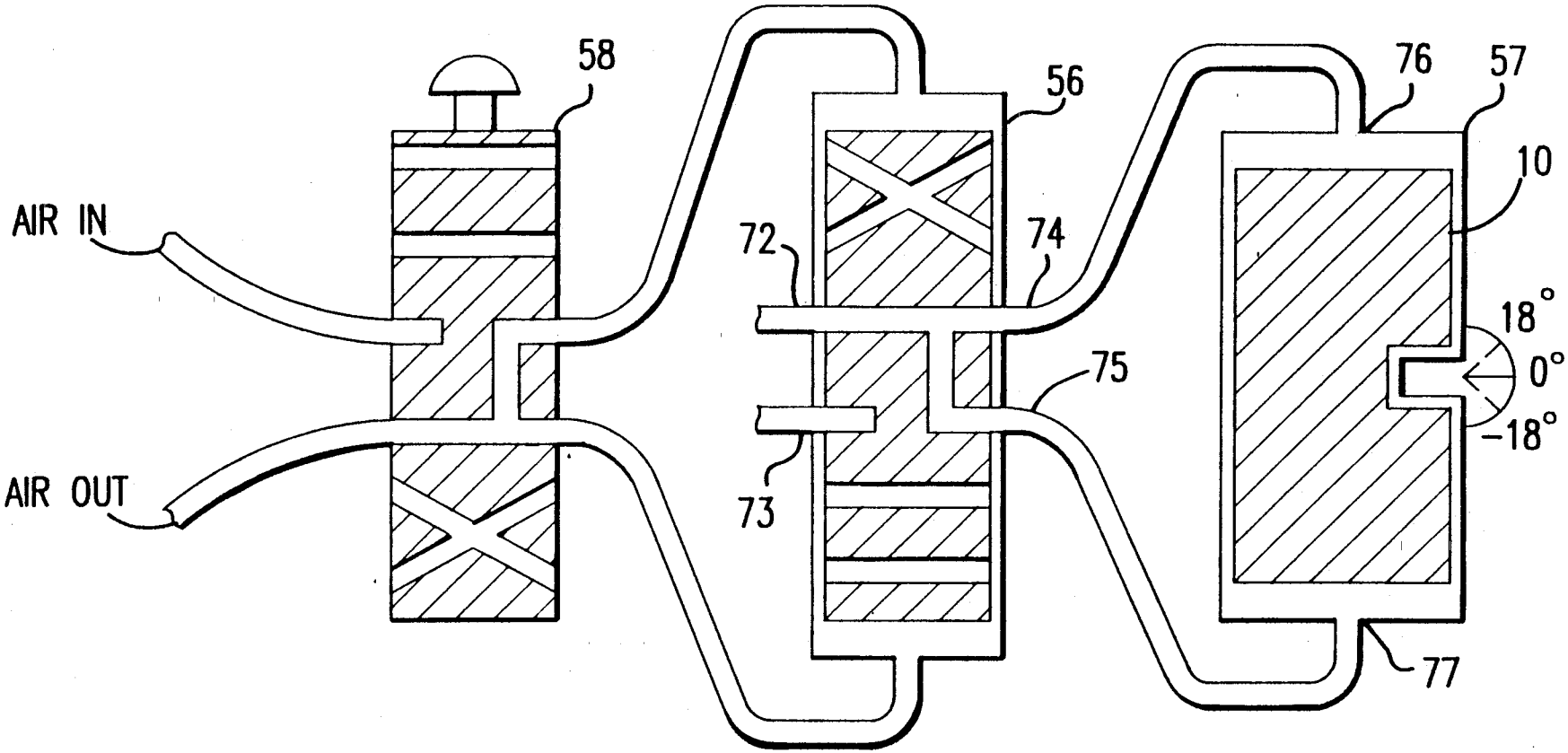
FIGS. 5A, 5B, and 5C are schematic diagrams showing three modes of operation of the manually-controlled pneumatic valve, the second directional control means, and the stroker means.
Figure 5B:
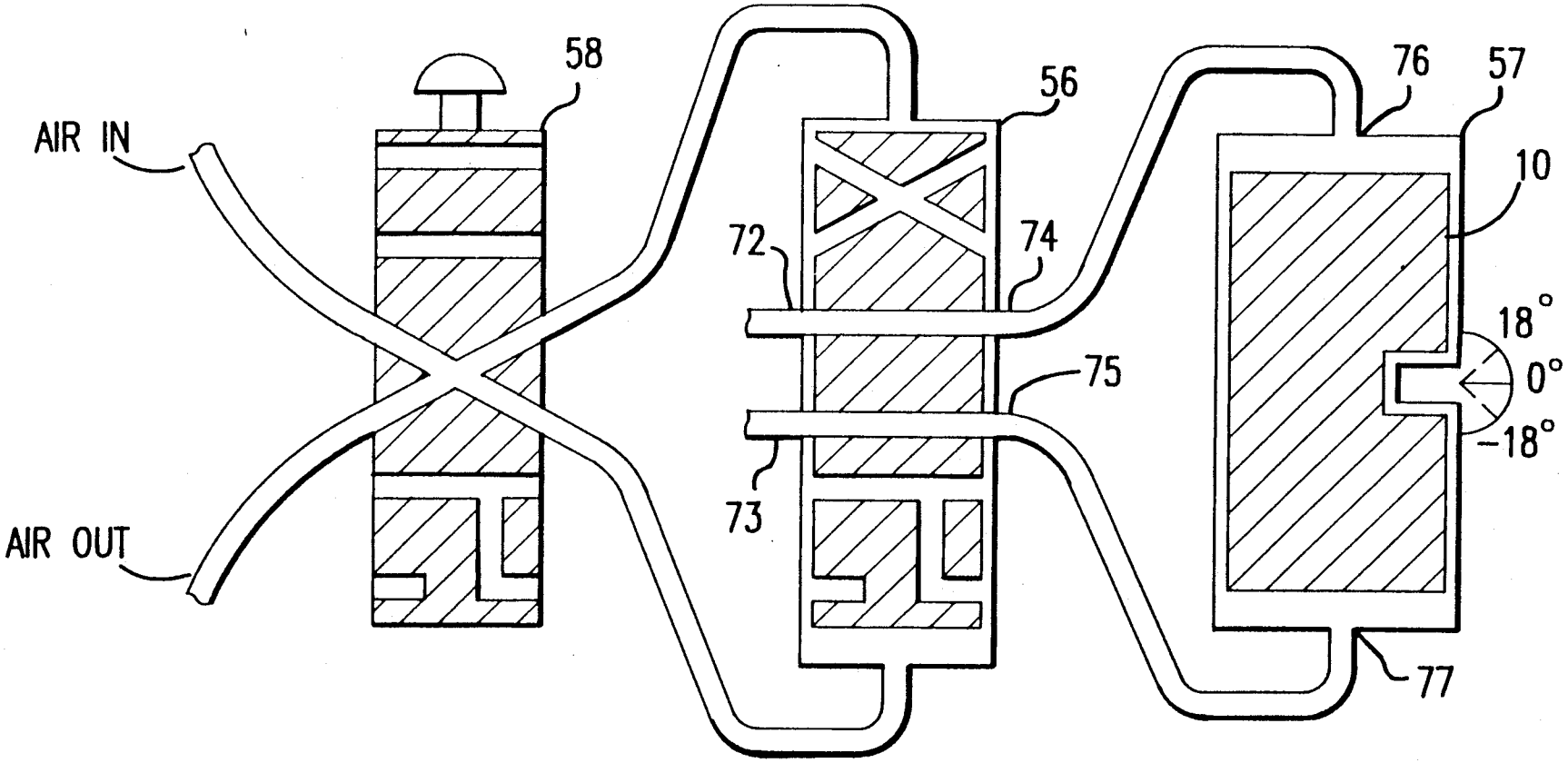
Figure 5C:
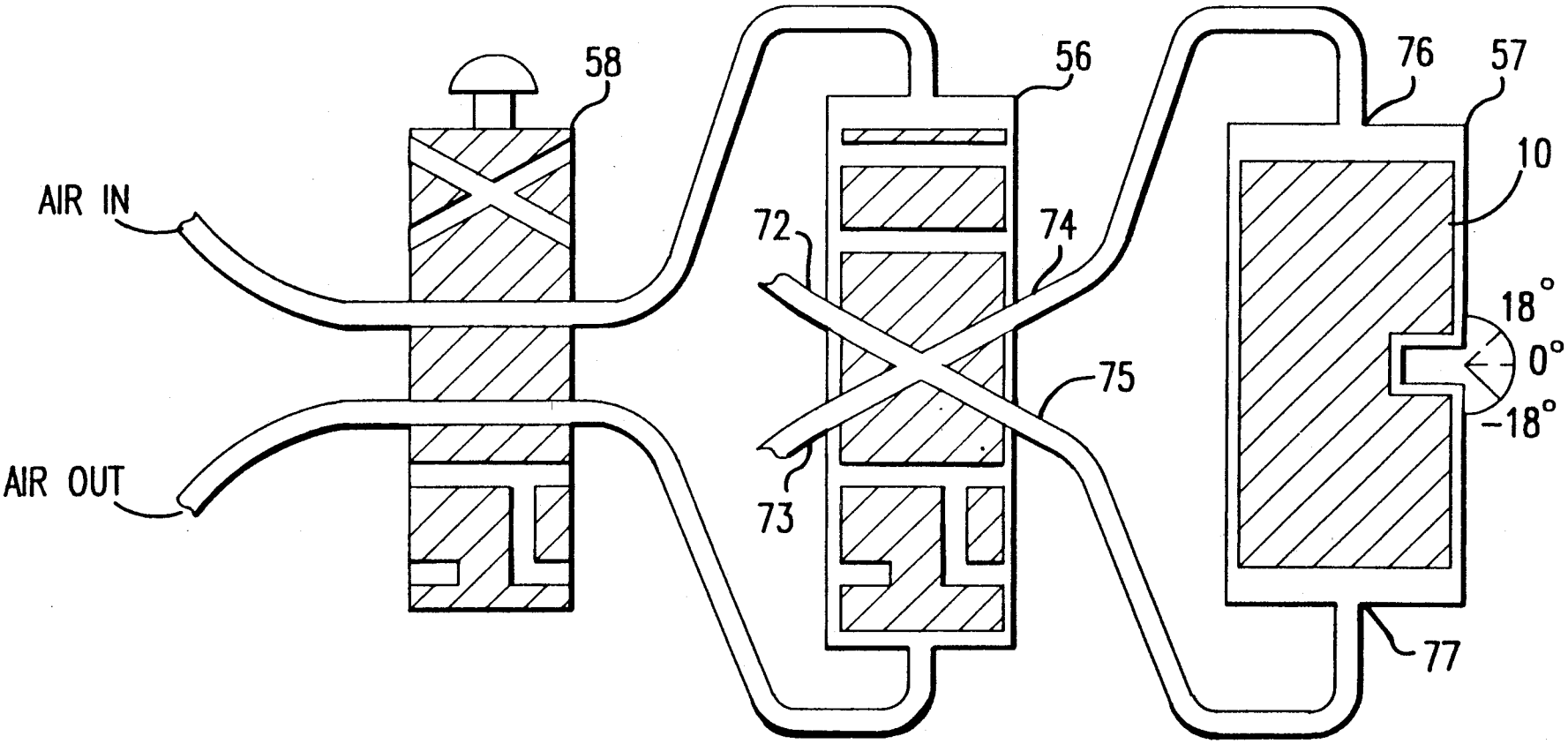

As shown in FIG. 5A, 5B, and 5C, the engaging means is preferably operable in three modes: hold, run, and stop. Alternately, the hold mode may be omitted. Elements 56 and 58 represent three-position directional control means. The three positions are schematically represented as a "cross," "parallel" or "single" line positions in FIGS. 5A, 5B, and 5C. Both pneumatic valve 58 and directional control means 56 are operable to switch from any one of the three positions to any other position, in any order.

In the "run" mode, directional control means 56 is in the parallel line position, and as shown in FIG. 5B, pneumatic valve 58 is in the cross line position (i.e., air from valve 58 moves directional control means 56 into the parallel line position). In this mode, liquid pressure flows through port 77 of stroker means 57 to force piston 103 to move, and thereby cause the cam angle to be at the $+18°$ position. Thus the pump 9 pumps compression liquid to accumulator 1, and drains liquid from accumulator 2 (see FIG. 4B). The system thus operates in the modes shown in FIGS. 4A and 4B, as previously described.

As shown in FIG. 5A, the operator moves the system into the "stop" mode by moving valve 58 to the single line position. In this position, valve 58 allows air pressure (preferably atmospheric) to flow to both sides of directional control means 56. When air is applied to both sides of directional control means 56, then directional control means 56 shifts to the single line position, thereby allowing supply liquid pressure to equalize on both sides of stroker means 57. The directional control means is preferably self-centering (e.g., spring-loaded so that it returns to a center position when equal air pressure is applied to both sides of it). In this manner, stroker means 57 moves to a zero cam angle position, and no liquid is pumped by pump 9. Directional control means 55 remains in the same position (either the parallel line or the cross line position, as shown in FIGS. 4A or 4B).

The operator moves the system from "run" to "hold" mode by moving valve 58 from the cross line to the parallel line position, as shown in FIG. 5C. When valve 58 is in the parallel line position, then directional control means 56 is forced into the cross line position, thereby switching the flow of control liquid to the stroker means 57, and causing the stroker means 57 to move to an opposition cam angle direction, and thus causing the pump 9 to switch direction of liquid flow. The directional control means 55 is unaffected. Thus the switching signal subsequently sent from the sensing means 50 or 51 to directional control means 55 has no effect, since directional control means 55 is already in place. Since directional control means 55 does not switch, then the accumulator that has been filled remains filled, the accumulator that has been drained remains drained, no gas is compressed, and the system remains "on hold" until the operator dictates otherwise.

The following example illustrates the "hold" mode. As shown in FIG. 4A, in "run" mode directional control means 55 sends supply liquid through directional control means 56 (which is in the parallel line "run" mode) to stroker means 57, causing the cam angle to be $-18°$, and liquid to flow from accumulator 1 to accumulator 2. When the operator moves valve 58 into the "hold" mode, then directional control means 56 moves to the cross-line position, thereby causing piston 103 to move, the cam angle to be $+18°$, and liquid to be pumped from accumulator 2 to accumulator 2. At this point, directional control means 55 is unaffected, and remains in the position shown in FIG. 4A, even though the stroker means 57 is in the position shown in FIG. 4B. When accumulator 1 is filled, proximity switch 50 sends a servo pressure signal through line 52 to directional control means 55. However directional control means 55 is already in the position shown in FIG. 4A, and the servo pressure sent from proximity switch 50 has no effect. Thus, accumulator I remains full of liquid, and accumulator 2 remains drained of liquid.

When the engaging means 56 is in the "hold" mode, pump 9 continues to pump liquid until a certain set outlet pressure is reached (the set pressure is reached relatively quickly since the pump 9 is no longer switching). In the preferred embodiment the set pressure is about 3800 psig. To prevent overpressurization of the system, some pressure control and/or release mechanism must be employed. Typically pressure release may be accomplished using relief valves or pressure control valves. In the preferred embodiment, however, the outlet pressure is controlled by reducing the cam angle as the set pressure is approached. As the cam angle is reduced, pump output (and hence pump output pressure) is reduced. This system is described in further detail below.

A preferred embodiment employs a Hagglunds/Dennison P11P pressure release system which normally operates in the following manner: As the output pressure is increased, the set pressure is approached. At the set pressure, a high pressure sequence valve opens, allowing a portion of the pump discharge liquid to recycle to vane actuators for a rocker hanger (i.e., a "vane chamber") in the pump, and this recycled liquid is applied such that it forces the stroking cam angle to be reduced. As the cam angle is reduced, liquid from the stroking cam is sequentially forced through dual level relief valves, control check valves, and back into the suction side of the pump 9 inlet. This system is shown in detail in FIG. 2.3, "11 and 14 CIPR Pump Circuit," in the Hagglunds/Dennison "'Gold Cup' Hydrostatic Transmission Application Manual," Bulletin 330, 6th Edition (Nov., 1988).

The above system is acceptable when the suction pressure of the pump 9 is low enough to allow liquid flow from the vane chamber (usually about 300–500 psig) to the return side of the pump 9. If the suction pressure of the pump 9 is high enough, however, liquid will not flow from the vane chamber to the pump 9. In this circumstance, the pump 9 must be modified to allow flow from the vane chamber (the cam angle cannot change unless liquid can flow from the vane chamber—if the cam angle cannot change, then pump output cannot be reduced). Preferably the pump system is modified by drilling additional ports in the dual level relief valve chambers to allow liquid flow from these chambers. The ports are connected to a pilot operated shuttle valve, which switches state at a high pump 9 discharge/suction pressure differentials, allowing liquid flow from the dual level relief valves to the liquid supply system in the event that the suction pressure is too high to allow flow to the pump inlet. The liquid that flows through the pilot operated shuttle valve may be recycled to the liquid reservoir or elsewhere in the system. In the preferred embodiment the liquid is recycled to the liquid supply system or a high pressure pilot control system.

Start-up and Operation

In the preferred embodiment, the independent supply pump 11 is first started, filling the pressure container 20 with liquid. Excess liquid flushes and primes the liquid control means, including the pump 9 and associated equipment. After the pressure in the liquid supply means has reached 300–350 psig, the operator will start the pump 9.

When the operator moves switch 58 to the run position the supply pump 10 will begin to supply liquid through directional control means 55 and 56 to the stroker means 57. As the pumping means 9 goes "on stroke" (i.e., cam angle comes off 0° and goes toward 18°) liquid is discharged from port 12 extending separator 4. As the separator extends, liquid pressure in the liquid supply means is temporarily reduced (until repressurized by the supply pump 10 or the independent supply pump 11), causing a slow start until cylinder 2 is filled with liquid. This "slow start" is beneficial to avoid shock to the system, prevent cavitation of pump 9, and allow the operator time to adjust and check system operations as needed.

As cylinder 4 reaches full extension it causes the sensing means 51 to send a signal (at the pressure delivered by the servo pumping means 100) to directional control means 55, which switches the discharge of liquid pressure from directional control valve 55 to the opposite side of the stroker means 57, causing the pump 9 to discharge liquid from port 13 to move separator 3. After the first stroke the closed loop system is now filled with liquid and will generally run at full speed with no further modulation from the liquid supply means. At full extension separator 3 shifts sensing means 50, causing the directional control means 55 to switch once again, causing the stroker to reverse and deliver liquid out of port 12 and extending separator 4.

One embodiment of the control system is shown in FIGS. 4A and 4B. In FIG. 4A, the system is in a run position and the separator 4 is extending. In FIG. 4B, the separator 4 has fully extended and depressed proximity switch 51, thereby causing directional control valve 55 to change position and reverse pumping means 9. As shown in FIGS. 4A and 4B, the single lines 52, 53, 54 and 101 comprise liquid at several pressures. The liquid flowing through line 71 in ports 70, 71, 72, 73, 74, 75, 76, 77, and 80 carries liquid at about liquid supply pressure (preferably about 300 to 350 psig). Port 81 is connected to vent to reservoir and thus liquid flowing through port 81 is at a pressure considerably less than the liquid supply pressure.

Figure 9:
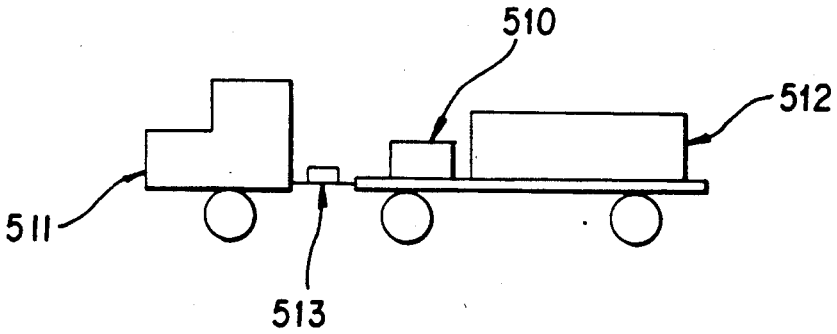
FIG. 9 is a schematic diagram of a compression system mounted on a vehicle.

In the more preferred embodiment, the compressor system 510 described herein and shown in FIG. 9 may be mounted on a vehicle 511 (e.g. car, boat, plane, train, or truck) such as a tractor trailer truck that is equipped with pressure vessel storage means. Specifically a Peterbilt 375 tractor is preferred. The hydraulic pumps are connected via a transfer case 513 (Dana Spicer, Model 764 or a Fabco PTO-170 (Oakland, California) preferred) to the engine of the tractor. A major advantage of the invention is that when this invention is mounted on a tractor trailer, then gas may be loaded onto the trailer, and off-loaded from the trailer utilizing the mobile compressor located on the trailer. In this manner, the need for compression equipment at both the loading and off-loading points is eliminated. In such an embodiment the trailer must be equipped with storage means 512 (e.g. tanks, pipes, etc.) to store gas.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein or in the steps or in the sequence of steps of the methods described herein without departing from the spirit and the scope of the invention as described in the following claims.

We claim:

1. A gas compression system, comprising:

a first accumulator;

a second accumulator;

a gas-supplying conduit connected to the accumulators;

a gas-receiving means connected to the accumulators;

liquid control means connected to alternatively introduce liquid into the first accumulator for forcing gas from it during use as liquid is drained from the second accumultor so as to cause the second accumulator to be refilled with gas from the gas-supplying conduit, and for introducing liquid into the second accumulator during use for forcing gas from it as liquid is drained from the first accumulator so as to cause the first accumulator to refilled with gas from the gas-supplying conduit; and wherein the liquid control means is adapted to reduce the rate that liquid is introduced into each accumulator before each accumulator is substantially filled with liquid during use.

2. A gas compression system, comprising:

a first accumulator;

a second accumulator;

a gas-supplying conduit connected to the accumulators;

a gas-receiving means connected to the accumulators;

a reversible pump operable to alternatively pump compression liquid from the first accumulator to the second accumulator for forcing gas from the second accumulator during use, and from the second accumulator to the first accumulator for forcing gas from the first accumulator during use;

a compression liquid control system operable to signal the reversible pump to switch compression liquid flow from the first accumulator to the second accumulator during use, and from the second accumulator to the first accumulator during use; and a diverting conduit for diverting a portion of the compression liquid during use from the reversible pump to a liquid cooler, wherein the cooler comprises a thermostat system operable to reduce the flow of liquid to the cooler as the temperature of the liquid flowing to the cooling during use decreases.

3. The system of claim 2 wherein the diverting conduit is connected through a pressure reduction means to the liquid cooler, the pressure reduction means being designed to reduce the pressure of the diverted liquid so that the cooler is operable at a pressure below the pressure of gas in the gas-supplying conduit.

4. A method of compressing gas, comprising the following steps:

introducing gas from a gas-supplying conduit to a first accumulator, while substantially simultaneously draining compression liquid from the first accumulator and pumping the compression liquid through a reversible pump to a second accumulator, wherein the compression liquid pumped into the second accumulator forces gas from the second accumulator to a gas-receiving conduit;

signaling the reversible pump to switch and pump compression liquid from the second accumulator to the first accumulator;

draining compression liquid from the second accumulator and pumping the compression liquid through a reversible pump to the first accumulator, wherein the compression liquid pumped into the first accumulator forces gas from the first accumulator to a gas-receiving conduit, while substantially simultaneously introducing gas from the gas-supplying conduit to the second accumulator;

diverting a portion of the compression liquid to a liquid cooler;

reducing the flow of the compression liquid to the cooler as the temperature of the compression liquid flowing to the cooler decreases.

5. The method of claim 4, further comprising the step of reducing the pressure of the compression liquid flowing to the cooler to a pressure less then the pressure of the gas in the gas-supplying conduit.

6. A gas compression system, comprising:

a first accumulator;

a second accumulator;

a gas-supplying conduit connected to the accumulators;

a gas-receiving conduit connected to the accumulators;

a reversible pump operable to alternatively pump compression liquid from the first accumulator to the second accumulator for forcing gas from the second accumulator during use, and from the second accumulator to the first accumulator for forcing gas from the first accumulator during use;

a compression liquid control system operable to signal the reversible pump to switch compression liquid flow from the first accumulator to the second accumulator during use, and from the second accumulator to the first accumulator during use, and wherein the compression liquid control system is adapted to reduce the rate of compression liquid flow during use to each accumulator before each accumulator is substantially filled with liquid.

7. The system of claim 6 wherein the compression liquid control system is adapted to reduce the rate of compression liquid flow to each accumulator during use when each accumulator is about 90% filled with compression liquid.

8. The system of claim 6 wherein the compression liquid control system is adapted to reduce the rate of compression liquid flow to each accumulator during use by reducing the pressure of the compression liquid flowing to the reversible pump.

9. A method of compressing gas, comprising the following steps:

introducing gas from a gas-supplying conduit to a first accumulator, while substantially simultaneously draining compression liquid from the first accumulator and pumping the compression liquid through a reversible pump to a second accumulator, wherein the compression liquid pumped into the second accumulator forces gas from the second accumulator to a gas-receiving conduit;

signaling the reversible pump to switch and pump compression liquid from the second accumulator to the first accumulator;

draining compression liquid from the second accumulator and pumping the compression liquid through a reversible pump to the first accumulator, wherein the compression liquid pumped into the first accumulator forces gas from the first accumulator to a gas-receiving conduit, while substantially simultaneously introducing gas from the gas-supplying conduit to the second accumulator;

reducing the rate that compression liquid is pumped into each accumulator before each accumulator is substantially filled with compression liquid.

10. The method of claim 9 wherein the rate is decreased by reducing the pressure of the compression liquid being pumped by the reversible pump.

11. The method of claim 9 wherein the rate is reduced when each accumulator is about 90% filled with compression liquid.

12. A gas compression system, comprising:

a first accumulator;

a second accumulator;

a gas-supplying conduit connected to the accumulators;

a gas-receiving means connected to the accumulators;

liquid control means connected to alternatively introduce liquid into the first accumulator for forcing gas from it during use as liquid is drained from the second accumulator so as to cause the second accumulator to be refilled with gas from the gas-supplying conduit, and for introducing liquid into the second accumulator during use for forcing gas from it as liquid is drained from the first accumulator so as to cause the first accumulator to refilled with gas from the gas-supplying conduit; and liquid supply means connected such that a portion of the liquid in the liquid control means is diverted from the liquid control means to a reservoir during use, and the liquid supply means is connected to pump liquid during use from the reservoir to a first connector connecting the first accumulator to the liquid control means, and from the reservoir to a second connector connecting the second accumulator to the liquid control means.

13. The system of claim 12 wherein the liquid control means comprises a first sensing means connected to switch the flow of liquid from the first accumulator to the second accumulator during use, and a second sensing means connected to switch the flow of liquid from the second accumulator to the first accumulator during use, and wherein the sensing means are adapted to each send a switching signal to a directional control means during use to cause the liquid to switch flow.

14. The system of claim 12 wherein the liquid supply means is adapted to supply liquid to the liquid control means during use after liquid is substantially drained from the first accumulator and before the second accumulator is substantially filled, and after the liquid is substantially drained from the second accumulator and before the first accumulator is substantially filled.

15. The system of claim 12 wherein the liquid supply means is adapted to supply liquid to the liquid control means during use at a pressure less than the pressure of gas in the gas-supplying conduit.

16. A method of compressing gas, comprising the following steps:

introducing gas from a gas-supplying conduit to a first accumulator, while substantially simultaneously draining compression liquid from the first accumulator and pumping the compression liquid through a reversible pump to a second accumulator, wherein the compression liquid pumped into the second accumulator forces gas from the second accumulator to a gas-receiving conduit;

signaling the reversible pump to switch and pump compression liquid from the second accumulator to the first accumulator;

draining compression liquid from the second accumulator and pumping the compression liquid through a reversible pump to the first accumulator, wherein the compression liquid pumped into the first accumulator forces gas from the first accumulator to a gas-receiving conduit, while substantially simultaneously introducing gas from the gas-supplying conduit to the second accumulator;

diverting a portion of the compression liquid to a reservoir;

pumping a portion of the compression liquid from the reservoir to a first connector connecting the first accumulator to the reversible pump, and to a second connector connecting the second accumulator to the reversible pump.

17. The method of claim 16, further comprising the step of supplying the compression liquid to the reversible pump when the first accumulator is substantially drained of compression liquid and before the second accumulator is substantially filled with compression liquid, and when the second accumulator is substantially drained of compression liquid and before the first accumulator is substantially filled with compression liquid.

18. The method of claim 16, further comprising the step of flowing gas through a means to prevent backflow of gas to the gas-supplying conduit prior to introducing gas into the accumulators.

19. The method of claim 16, further comprising the step of flowing gas through a means to prevent backflow of gas to the accumulators prior to forcing gas into the gas-receiving conduit.

20. The method of claim 16, further comprising the step of supplying the compression liquid with a supply pump.

21. The method of claim 16, further comprising the step of supplying the compression liquid from a pressure container comprising a compressible element.

22. The method of claim 16, further comprising the steps of sending a signal from the first accumulator to a directional control means when the first accumulator is substantially filled with gas; and sending a signal from the directional control means to the reversible pump to switch and pump liquid from the second accumulator to the first accumulator.

23. The method of claim 16, further comprising the steps of sending a signal from the first accumulator to a stroker means when the first accumulator is substantially filled with gas; and sending a signal from the stroker means to the reversible pump to switch and pump liquid from the second accumulator to the first accumulator.

24. The method of claim 16, further comprising the step of supplying compression liquid to the reversible pump at a pressure less than the pressure of the gas in the gas-supplying conduit.

25. The method of claim 16, further comprising the step of supplying compression liquid to the reversible pump from a supply system at a momentary rate at least equal to the rate that compression liquid is pumped by the reversible pump.

26. The method of claim 25, further comprising the step of diverting a portion of the compression liquid from the reversible pump to a reservoir, and supplying liquid to the reversible pump from a supply system at a momentary rate at least equal to the rate that compression liquid is pumped by the reversible pump plus the rate that compression liquid is diverted from the reversible pump.

27. The method of claim 16, further comprising the step of engaging the reversible pump in a stop or run mode by controlling the signal sent to the reversible pump.

28. The method of claim 27, further comprising the step of engaging the reversible pump in a hold mode by controlling the signal sent to the reversible pump.

29. The method of claim 16, further comprising the step of preventing momentary compression liquid pressure in the accumulators from rising above a set amount above the pressure of the gas in the gas-receiving conduit.

30. The method of claim 29 wherein the momentary compression liquid pressure in the accumulators is prevented from rising by diverting a portion of the compression liquid from the reversible pump to a diverting conduit.

31. The method of claim 30 wherein the compression liquid is diverted through a spring-loaded valve prior to being diverted to the diverting conduit.

32. A gas compression system, comprising:

a first accumulator;

a second accumulator;

a gas-supplying conduit connected to the accumulators;

a gas-receiving conduit connected to the accumulators;

a reversible pump operable to alternatively pump compression liquid from the first accumulator to the second accumulator for forcing gas from the second accumulator during use, and from the second accumulator to the first accumulator for forcing gas from the first accumulator during use;

a compression liquid control system operable to signal the reversible pump to switch compression liquid flow from the first accumulator to the second accumulator during use, and from the second accumulator to the first accumulator during use;

a liquid supply pump connected to supply compression liquid to the reversible pump during use; and wherein the gas compression system is connected such that a portion of the compression liquid is diverted from the reversible pump to a reservoir during use, and the liquid supply pump is connected to pump compression liquid during use from the reservoir to a first connector connecting the first accumulator to the reversible pump, and from the reservoir to a second connector connecting the second accumulator to the reversible pump.

33. The system of claim 32 wherein the liquid supply pump is connected to supply compression liquid to the accumulators during use when the first accumulator is substantially drained of compression liquid and before the second accumulator is substantially filled with liquid, and when the second accumulator is substantially drained of liquid and before the first accumulator is substantially filled with liquid.

34. The system of claim 32 wherein the liquid supply pump is connected to supply compression liquid to the reversible pump during use at a pressure below the pressure of gas in the gas-supplying conduit.

35. The system of claim 32, further comprising a means to prevent backflow from the first connector to the liquid supply pump, and a means to prevent backflow from the second connector to the liquid supply pump.

36. The system of claim 32 wherein the liquid supply pump is further connected to pump liquid during use to a pressure container comprising a compressible element, and the pressure container is connected to provide liquid to the first and second connectors during use.

37. The system of claim 32 wherein the liquid supply pump is operable independently of the reversible pump, and is operable to prime the reversible pump.

38. The system of claim 32, further comprising a means to prevent backflow of gas from the accumulators to the gas-supplying conduit during use.

39. The system of claim 32, further comprising a means to prevent backflow of gas from the gas-receiving conduit to the accumulators during use.

40. The system of claim 1 wherein the liquid control system comprises a first sensing means connected to the first accumulator, a second sensing means connected to the second accumulator, and wherein the reversible pump comprises a stroker means, and wherein the sensing means are each adapted to send a switching signal to a stroker means to cause the reversible pump to switch the direction of compression liquid flow.

41. The system of claim 1 wherein the liquid supply means is adapted to supply liquid to the liquid control means during use, and wherein the liquid supply means comprises a pressure container comprising a compressible element.

42. The system of claim 12, further comprising a separator in the first accumulator to separate gas from compression liquid during use, and a separator in the second accumulator to separate gas from compression liquid during use.

43. The system of claim 9 wherein the separators are recessed.

44. The system of claim 32 wherein the gas compression system is mounted on a vehicle.

45. The system of claim 44 wherein the vehicle comprises a gas storage means, and the compression system is connected to compress gas into the storage means and to compress gas from the storage means.

46. The system of claim 1, further comprising a compression liquid compensation system adapted to prevent momentary compression liquid pressure in the accumulators from rising a set amount above the pressure of gas in the gas-receiving conduit.

47. The system of claim 46 wherein the compression liquid compensation system comprises a spring-loaded valve connected to release compression liquid pressure during use when the momentary compression liquid pressure in the accumulators rises a set amount above the pressure of gas in the gas-receiving means.

48. The system of claim 1 wherein the liquid control system comprises a first sensing means connected to the first accumulator, a second sensing means connected to the second accumulator, and wherein the sensing means are each adaptable to send a switching signal during use to a directional control means which then switches state and causes the reversible pump to switch the direction of compression liquid flow.

49. The system of claim 48 wherein the reversible pump comprises a stroker means connected such that a supply liquid flows during use from the directional control means to the stroker means, and wherein a change in direction of supply liquid flow to the stroker means during use causes the reversible pump to switch the direction of compression liquid flow.

50. The system of claim 49 connected such that the amount of supply liquid pressure in the stroker means during use controls the amount of compression liquid flow to and from the reversible pump.

51. The system of claim 50 connected such that a reduction in the pressure of the compression liquid flowing to the reversible pump during use causes a reduction in the supply liquid pressure in the stroker means.

52. The system of claim 1, further comprising an engaging means connected to provide a run mode and a stop mode for the reversible pump, and wherein the engaging means are adapted to provide such modes by controlling flow of a supply liquid to controls of the reversible pump.

53. The system of claim 52 wherein the controls of the reversible pump comprise a stroker means with two ports for receiving supply liquid.

54. The system of claim 53 wherein the engaging means comprises a directional control means connected to provide the stop mode by equalizing the supply liquid flow to both ports in the stroker means.

55. The system of claim 53 wherein the directional control means is connected to provide the run mode by allowing directional flow of supply liquid to the stroker means.

56. The system of claim 52 wherein the engaging means further comprises a hold mode for the reversible pump.

57. The system of claim 56 wherein the compression liquid control system comprises a first sensing means connected to the first accumulator, a second sensing means connected to the second accumulator, and wherein the sensing means are each adapted to send a directional supply liquid signal to the reversible pump to cause the reversible pump to switch the flow of compression liquid, and wherein the engaging means comprises a directional control means connected to provide the hold mode by switching the direction of the supply liquid signal to the reversible pump.

58. The system of claim 57 wherein the engaging means is connected to provide the hold mode by switching the direction of supply liquid such that the directional supply liquid signal sent by the sensing means to the reversible pump does not cause the reversible pump to switch the flow of compression liquid.

59. The system of claim 1, further comprising a pressure container comprising a compressible element, and wherein the pressure container is connected to supply compression liquid to the reversible pump during use.

60. The system of claim 59 wherein the compressible element comprises a bladder filled with a gas.

61. The system of claim 59 wherein the pressure container is adapted to supply liquid during use at a momentary rate at least equal to about the rate that liquid is introduced into an accumulator.

62. The system of claim 57 wherein a liquid supply pump is connected to supply liquid to the pressure container.

63. The system of claim 62 wherein the supply pump is connected to draw liquid from a reservoir.

64. The system of claim 62 wherein the liquid supply pump is connected to supply liquid during use to the reversible pump and the pressure container.

* * * * *

UNITED STATES PATENT AND TRADEMARK OFFICE

CERTIFICATE OF CORRECTION

PATENT NO. : 5,169,295

DATED : December 8, 1992

INVENTOR(S) : John Stogner et al

It is certified that error appears in the above-indentified patent and that said Letters Patent is hereby corrected as shown below:

In Column 23, line 20 (claim 2), please delete "means" and insert therefor -- conduit --.

In Column 23, line 38 (claim 2), please delete "cooling" and insert therefor -- cooler --.

In Column 28, line 16 (claim 40), please delete "1" and insert therefor -- 32 --.

In Column 28, line 30 (claim 42), please delete "12" and insert therefor -- 32 --.

In Column 28, line 35 (claim 43), please delete "9" and insert therefor -- 42 --.

In Column 28, line 43 (claim 46), please delete "1" and insert therefor -- 32 --.

UNITED STATES PATENT AND TRADEMARK OFFICE

CERTIFICATE OF CORRECTION

PATENT NO. : 5,169,295

DATED : December 8, 1992

INVENTOR(S) : John Stogner et al

BEST AVAILABLE COPY

It is certified that error appears in the above-indentified patent and that said Letters Patent is hereby corrected as shown below:

In Column 28, line 54 (claim 48), please delete "1" and insert therefor -- 32 --.

In Column 29, line 10 (claim 52), please delete "1" and insert therefor -- 32 --.

In Column 29, line 23 (claim 55), please delete "53" and insert therefor -- 54 --.

In Column 30, line 14 (claim 59), please delete "1" and insert therefor -- 32 --.

In Column 30, line 25 (claim 62), please delete "57" and insert therefor -- 59 --.

Signed and Sealed this

Eighth Day of February, 1994

Bruce Lehman

*Attest:*

BRUCE LEHMAN

*Attesting Officer*

*Commissioner of Patents and Trademarks*